US008240842B2

(12) United States Patent
Ito et al.

(10) Patent No.: US 8,240,842 B2
(45) Date of Patent: Aug. 14, 2012

(54) INK-JET RECORDING APPARATUS

(75) Inventors: Shingo Ito, Kasugai (JP); Noritsugu Ito, Tokoname (JP); Yoichi Shikai, Nagoya (JP); Wataru Sugiyama, Aichi-ken (JP); Naokazu Tanahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1039 days.

(21) Appl. No.: 12/023,869

(22) Filed: Jan. 31, 2008

(65) Prior Publication Data

US 2008/0186374 A1 Aug. 7, 2008

(30) Foreign Application Priority Data

Jan. 31, 2007 (JP) ..... 2007-022476

(51) Int. Cl.
*B41J 2/01* (2006.01)

(52) U.S. Cl. ..... 347/104; 347/101

(58) Field of Classification Search ..... None
See application file for complete search history.

(56) References Cited

U.S. PATENT DOCUMENTS

| | | | | |
|---|---|---|---|---|
| 2002/0154203 | A1 | 10/2002 | Tanaka | |
| 2003/0085979 | A1 | 5/2003 | Ishii et al. | |
| 2005/0225621 | A1 | 10/2005 | Ishii et al. | |
| 2006/0170749 | A1 * | 8/2006 | Watanabe | 347/104 |
| 2006/0268087 | A1 * | 11/2006 | Sasa | 347/101 |
| 2007/0146463 | A1 | 6/2007 | Sasa | |

FOREIGN PATENT DOCUMENTS

| | | | |
|---|---|---|---|
| JP | 2002-036605 | A | 2/2002 |
| JP | 2002-103586 | A | 4/2002 |
| JP | 2002-211056 | A | 7/2002 |
| JP | 2002-307769 | A | 10/2002 |
| JP | 2003-103849 | A | 4/2003 |
| JP | 2003-285487 | A | 10/2003 |
| JP | 2004-082385 | A | 3/2004 |
| JP | 2005-059475 | A | 3/2005 |
| JP | 2006-326990 | A | 12/2006 |

OTHER PUBLICATIONS

Japan Patent Office, Notification of Reason for Refusal for Japanese Patent Application No. 2007-022476 (counterpart to above-captioned patent application), dispatched Jun. 21, 2011.

* cited by examiner

*Primary Examiner* — Matthew Luu
*Assistant Examiner* — Kendrick Liu
(74) *Attorney, Agent, or Firm* — Baker Botts L.L.P.

(57) ABSTRACT

An ink-jet recording apparatus, including a movable support member which includes a supporting portion that supports a recording medium fed on a platen and which is slid in a feeding direction so as to the recording medium, wherein the movable support member includes an ink receiving portion which is provided such that a clearance is formed between the ink receiving portion and the supporting portion, which is relatively low in height, and which receives ink droplets ejected to an outside of the recording medium, or wherein the supporting portion includes: a step portion having a transfer preventing face which prevents adhering ink from transferring upward; and an ink receiving face continuous to the transfer preventing face and extending in a generally horizontal direction so as to receive ink droplets ejected to an outside of the recording medium.

15 Claims, 27 Drawing Sheets

INK-JET RECORDING APPARATUS

The present application claims priority from Japanese Patent Application No. 2007-022476, which was filed on Jan. 31, 2007, the disclosure of which is herein incorporated by reference in its entirety.

BACKGROUND OF THE INVENTION

1. Field of the Invention

The present invention relates to an ink-jet recording apparatus which records an image on a recording medium by ejecting ink droplets from a recording head.

2. Description of the Related Art

FIGS. 27A, 27B, 27C, and 27D schematically show a manner of a non-margin recording operation in a conventional ordinary ink-jet recording apparatus.

This ink-jet recording apparatus includes a recording head 1. A plurality of nozzles are provided in rows in this recording head 1. A recording medium 2 (typically, a recording sheet) on which an image is to be recorded is fed to below the recording head 1. The recording head 1 is moved in a direction perpendicular to a feeding direction 3 of the recording sheet 2, that is, in a direction perpendicular to the sheet surface of the figure (a main scanning direction). Ink droplets are ejected from the above-described nozzles at predetermined timings while the recording head 1 is moved. As a result, an image is recorded on the recording sheet 2.

Recent ink-jet recording apparatuses have a function in which an image is recorded on the recording sheet 2 like a photographic printing, for example. The image recording operation like this is performed without any margin provided on edges of the recording sheet 2, and thus referred to as what is called a "non-margin recording operation". When the non-margin recording operation is performed, a distance in particular between an end portion of the recording sheet 2 and the recording head 1 must be precisely maintained. Thus, a platen 4 includes, in addition to fixed ribs 5, a movable rib 6 which is slid in the feeding direction 3. As described in Japanese Patent Application Publication No. 2006-326990, for example, this movable rib 6 supports the recording sheet 2 from below so as to follow the recording sheet 2 being fed during an image recording operation. Specifically, the non-margin recording operation is performed according to the following manner.

As shown in FIG. 27A, before the recording sheet 2 is fed to the platen 4, the movable rib 6 is located at a center of the platen 4. As shown in FIG. 27B, while the recording sheet 2 is fed onto the platen 4 by a sheet-feed roller 7, the movable rib 6 is slid toward an upstream side in the feeding direction. That is, the movable rib 6 moves nearer to the recording sheet 2 in order to support a leading end portion of the recording sheet 2. Thereafter, in a state in which the leading end portion of the recording sheet 2 is supported by the movable rib 6 (as shown in FIG. 27C), the movable rib 6 is slid toward a downstream side in the feeding direction while supporting the recording sheet 2 (as shown in FIG. 27D). Thus, the distance between the recording sheet 2 and the recording head 1 is precisely maintained.

SUMMARY OF THE INVENTION

In the non-margin recording operation, the recording head 1 ejects the ink droplets to an outside of the recording sheet 2 beyond an end portion thereof. Thus, the ink droplets adhere to the movable rib 6. In FIGS. 27A and 27B, the ink droplets adhere to a specific portion 8 of the movable rib 6. Further, the ink droplets adhering to the movable rib 6 tend to spread by transferring on the movable rib 6, and, in some instances, the ink droplets transfer to a top part of the movable rib 6, that is, a part thereof supporting the recording sheet 2. Thus, there arises a problem in which a back surface of the recording sheet 2 gets soiled with the inks.

This problem is solved if the apparatus is improved such that, among the ink droplets ejected from the recording head 1, all the ink droplets ejected to the outside of the recording sheet 2 adhere to a part different from the movable rib 6. However, an ejecting range of the recording head 1 is short, that is, a distance in which the recording head 1 can cause the ink droplets to reach its target is short. Thus, it is difficult that the recording head 1 ejects the ink droplets such that the ink droplets adhere to a specific position of the platen 4, leading to a possibility of generation of an ink mist in the vicinity of the platen 4. As a result, there arises another problem in which, in addition to soil of the recording sheet 2 with this ink mist, the ink mist may adhere to driving parts or other components to cause faulty operations by being suspended in the ink-jet recording apparatus.

Therefore, it is an object of the present invention to provide an ink-jet recording apparatus in which soil of the recording medium and the inside of the apparatus with the inks can be prevented, and a high quality non-margin recording operation can be performed. This object may be achieved according to one of two aspects of the present invention which will be described below.

In a first aspect of the present invention, there is provided an ink-jet recording apparatus including (a) a platen which supports a recording medium that is fed in a feeding direction; (b) a recording head disposed so as to be opposed to the platen, and configured to record an image on the recording medium by ejecting ink droplets onto the recording medium fed on the platen while reciprocating in a main scanning direction perpendicular to the feeding direction; and (c) a movable support member which includes a supporting portion that supports the recording medium at a top part thereof and which is slid in the feeding direction so as to follow the fed recording medium, wherein the movable support member includes an ink receiving portion which is provided adjacent to the supporting portion such that a clearance is formed between the ink receiving portion and the supporting portion, which is lower than the top part of the supporting portion in height, and which receives ink droplets ejected to an outside of the recording medium.

According to this ink-jet recording apparatus, the recording medium is fed onto the platen, and the recording head ejects the ink droplets while reciprocating in the main scanning direction. Thus, a desired image is recorded on the recording medium. The recording medium is supported by the supporting portion of the movable support member at the top part thereof. The movable support member moves in the feeding direction while supporting the recording medium. Thus, a distance between the recording medium and the recording head is kept constant, thereby realizing a high quality recording. In particular, a relatively high degree of effectiveness is obtained where what is called the non-margin recording operation is performed.

Where the non-margin recording operation is performed, the recording head ejects the ink droplets also to an outside of the recording medium. The ink droplets ejected to the outside of the recording medium fly toward the platen without adhering to the recording medium. The ink droplets flown toward the platen reliably adhere to the above-described ink receiving portion. Thus, the generation of the ink mist in the vicinity of the platen is prevented, thereby preventing the recording medium from getting soiled with the ink mist. In the above-described movable support member, the ink receiving portion is lower in height than the top part of the supporting portion. Thus, the recording medium does not contact the ink receiving portion. Consequently, the ink droplets adhering to the ink receiving portion do not directly transfer to the recording medium. Further, in the above-described movable support member, the clearance is formed between the supporting portion and the ink receiving portion. Thus, even if the ink droplets move from the ink receiving portion toward the supporting portion, these ink droplets are caught by the above-described clearance. That is, the above-described clearance functions as a trap for catching the ink droplets. Thus, the ink droplets do not transfer from the ink receiving portion to the recording medium.

In a second aspect of the present invention, there is provided an ink-jet recording apparatus including (a) a platen which supports a recording medium that is fed in a feeding direction; (b) a recording head disposed so as to be opposed to the platen, and configured to record an image on the recording medium by ejecting ink droplets onto the recording medium fed on the platen while reciprocating in a main scanning direction perpendicular to the feeding direction; and (c) a movable support member which includes a supporting portion that supports the recording medium and which is slid in the feeding direction so as to follow the fed recording medium, wherein the supporting portion includes: a step portion having a transfer preventing face which prevents adhering ink from transferring upward; and an ink receiving face continuous to the transfer preventing face and extending in a generally horizontal direction so as to receive ink droplets ejected to an outside of the recording medium.

According to this ink-jet recording apparatus, the recording medium is fed onto the platen, and the recording head ejects the ink droplets while reciprocating in the main scanning direction. Thus, a desired image is recorded on the recording medium. The recording medium is supported by the supporting portion of the movable support member. The movable support member moves in the feeding direction while supporting the recording medium. Thus, a distance between the recording medium and the recording head is kept constant, thereby realizing a high quality recording. In particular, a relatively high degree of effectiveness is obtained where what is called the non-margin recording operation is performed.

Where the non-margin recording operation is performed, the recording head ejects the ink droplets also to an outside of the recording medium. That is, the ink droplets ejected to the outside of the recording medium fly toward the platen without adhering to the recording medium. The ink droplets flown toward the platen adhere to the above-described step portion. Specifically, the ink droplets adhere to the ink receiving face of the supporting portion included in the movable support member. Thus, the generation of the ink mist in the vicinity of the platen is prevented, thereby preventing the recording medium from getting soiled with the ink mist. In addition, the supporting portion of the movable support member includes the above-described transfer preventing face. Thus, even if the ink droplets adhere to the above-described ink receiving face, the above-described transfer preventing face prevents these ink droplets from transferring to an upper end of the above-described supporting portion, that is, a portion of the supporting portion which contacts the recording medium. Consequently, the ink droplets adhering to the supporting portion do not directly transfer to the recording medium.

In summary, according to the present invention, even where the non-margin recording operation is performed, for example, the ink receiving portion or the ink receiving face reliably catches the ink droplets flown to the outside of the recording medium. Thus, the ink droplets are prevented from transferring on the supporting portion to the recording medium, and the generation of the ink mist is prevented. Consequently, the recording medium is prevented from getting soiled with the ink.

BRIEF DESCRIPTION OF THE DRAWINGS

The above and other objects, features, advantages, and technical and industrial significance of the present invention will be better understood by reading the following detailed description of preferred embodiments of the invention, when considered in connection with the accompanying drawings, in which.

DESCRIPTION OF THE PREFERRED EMBODIMENTS

Hereinafter, there will be described preferred embodiments of the present invention by reference to the drawings. It is to be understood that the following embodiments are described only by way of example, and the invention may be otherwise embodied with various modifications without departing from the scope and spirit of the invention.

First Embodiment

1. Overall Construction

Figure 1:
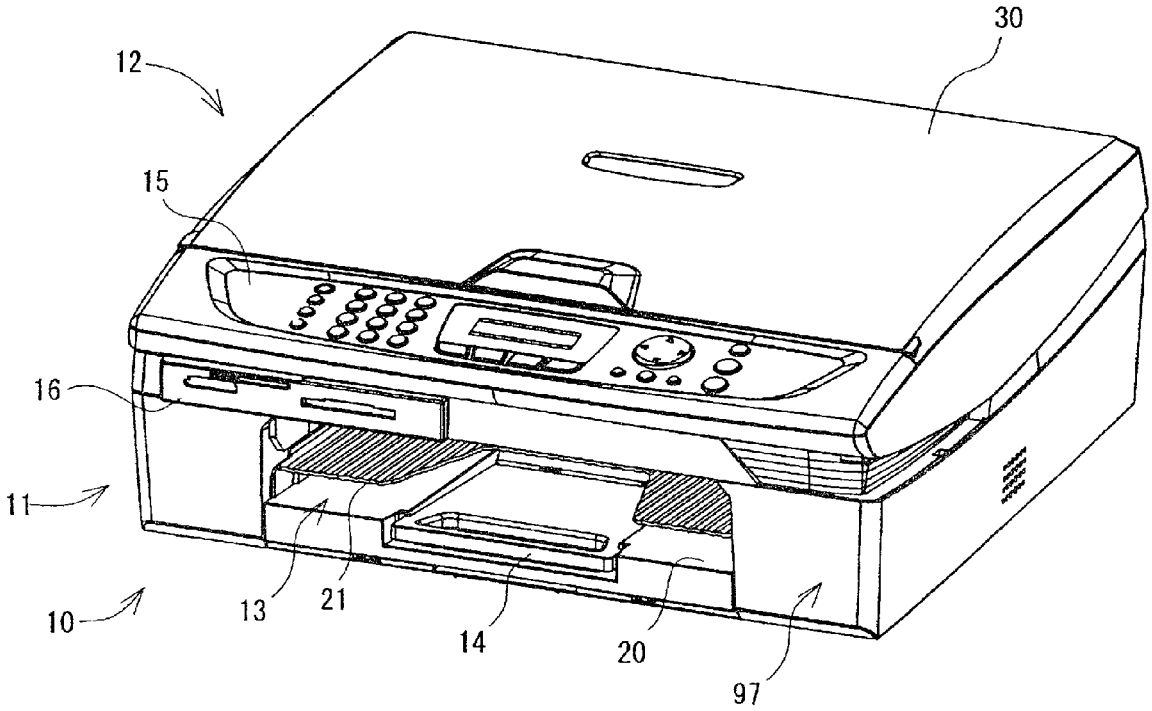
FIG. 1 is an external perspective view of a multi-function apparatus as a first embodiment of the present invention.
Figure 2:
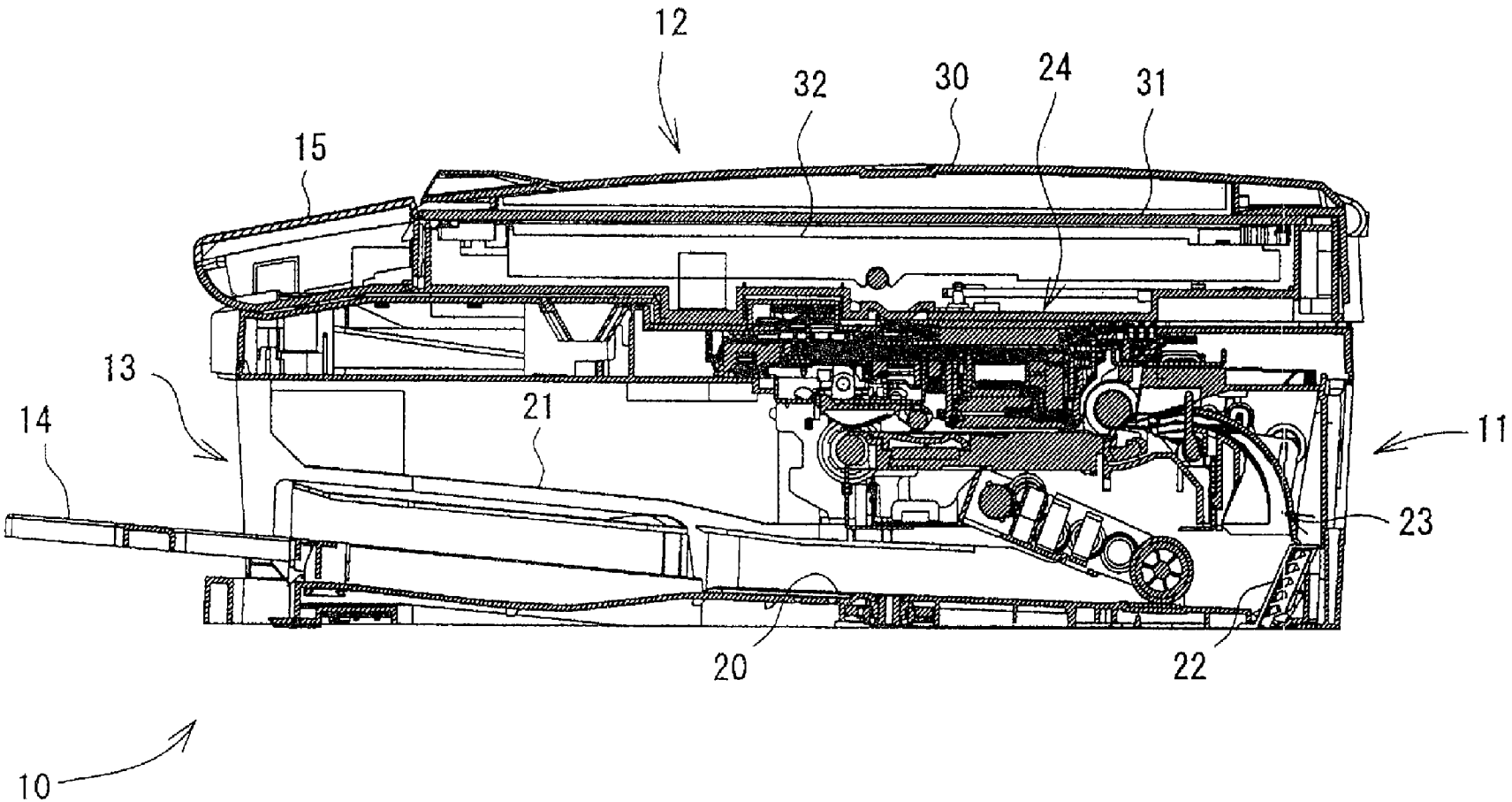
FIG. 2 is an elevational view of the multi-function apparatus as the first embodiment of the present invention in vertical cross section.

FIG. 1 is an external perspective view of a multi-function apparatus 10 as a first embodiment of the present invention. FIG. 2 is an elevational view showing an internal construction of the multi-function apparatus 10 in vertical cross section.

The multi-function apparatus 10 is a Multi Function Device (MFD) that includes a printer section 11 and a scanner section 12 and has a printing function, a scanning function, a copying function, and a facsimile function. The printer section 11 of the multi-function apparatus 10 corresponds to an ink-jet recording apparatus to which the present invention is applied. Thus, in the multi-function apparatus 10, the functions other than the printer function may be omitted, that is, the ink-jet recording apparatus of the present invention may be configured, for example, as a single-function printer from which the scanner section 12 is omitted.

The printer section 11 of the multi-function apparatus 10 is mainly connected to an external information device, e.g., a computer or the like. The printer section 11 records an image and/or characters on a recording sheet as a recording medium on the basis of recording data including image data and/or character data transmitted from the computer or the like. Further, a digital camera or the like can be connected to the multi-function apparatus 10. The printer section 11 records an image on the recording sheet on the basis of image data outputted from the digital camera or the like. Furthermore, one or ones of various storage media can be mounted in the multi-function apparatus 10. The printer section 11 can record an image on the recording sheet on the basis of image data or the like stored in the one or ones of storage media.

As shown in FIG. 1, a width and a depth of the multi-function apparatus 10 is larger than a height thereof, so that the multi-function apparatus 10 has, as an external shape, a generally wide and flat rectangular parallelepiped shape. The printer section 11 is positioned at a lower portion of the multi-function apparatus 10. An opening 13 is provided in the front side of the printer section 11. A sheet-supply tray 20 and a sheet-discharge tray 21 are superposed on each other in a vertical direction in the opening 13. The sheet-supply tray 20 is for accommodating recording sheets. The sheet-supply tray 20 has a slide tray 14. As shown in FIG. 2, the slide tray 14 is pulled out when necessary. Pulling out the slide tray 14 enlarges a tray area. One of the recording sheets accommodated in the sheet-supply tray 20 is supplied toward an inside of the printer section 11. The printer section 11 records a desired image on the supplied recording sheet. Then, the recorded recording sheet on which the image is recorded is discharged to the sheet-discharge tray 21.

The scanner section 12 is positioned at an upper portion of the multi-function apparatus 10. The scanner section 12 is constituted as what is called a flat-bed scanner. As shown in FIGS. 1 and 2, a document cover 30 is provided as a top plate of the multi-function apparatus 10. The document cover 30 is openable and closable. Below the document cover 30, a platen glass 31 and an image sensor 32 are provided. A document which is to be read as an image is placed on the platen glass 31. Below the platen glass 31, the image sensor 32 is disposed. A main scanning direction of the image sensor 32 coincides with a depth direction of the multi-function apparatus 10 (a right and left direction in FIG. 2). The image sensor 32 can reciprocate in a width direction of the multi-function apparatus 10 (a direction perpendicular to the sheet surface of FIG. 2).

On the front side of the upper portion of the multi-function apparatus 10, there is provided an operation panel 15. The operation panel 15 is a device through which the printer section 11 and the scanner section 12 are operated. The operation panel 15 is constituted by various types of operation buttons, a liquid crystal display portion, and so on. The multi-function apparatus 10 is configured to be operated in accordance with operational commands from the operation panel 15. Where the multi-function apparatus 10 is connected to an external computer, the multi-function apparatus 10 is operated also in accordance with commands transmitted from the external computer via a printer driver or a scanner driver. In addition, as shown in FIG. 1, at an upper left portion of the front side of the multi-function apparatus 10, there is provided a slot portion 16. A small-size memory card of various types as a memory medium can be mounted in the slot portion 16. Image data stored in the small-size memory card is read out when the user operates the operation panel 15 in a predetermined manner with the small-size memory card mounted in the slot portion 16. Information relating to the read image data is displayed on the liquid crystal display portion of the operation panel 15. On the basis of the display of the liquid crystal display portion, the printer section 11 records an arbitrary image on the recording sheet.

2. Brief Explanation of Printer Section

Hereinafter, there will be explained an internal construction of the multi-function apparatus 10, and more particularly a construction of the printer section 11.

As shown in FIG. 2, the sheet-supply tray 20 is disposed at the bottom portion of the multi-function apparatus 10. On a rear side of the sheet-supply tray 20, a slant sheet separator plate 22 is disposed. The slant sheet separator plate 22 separates the recording sheets supplied from the sheet-supply tray 20 and guides an uppermost recording sheet upward. A sheet-feed path 23 initially extends upward, then turns toward the front side of the multi-function apparatus 10. Further, the sheet-feed path 23 extends from the rear side toward the front side of the multi-function apparatus 10 while passing through an image recording unit 24 and finally reaching the sheet-discharge tray 21. Accordingly, the recording sheet accommodated in the sheet-supply tray 20 is fed to the image recording unit 24 while being guided through the sheet-feed path 23 so as to make an upward U-turn. After the recording sheet is subjected to a recording operation by the image recording unit 24, the recording sheet is discharged to the sheet-discharge tray 21.

Figure 3:
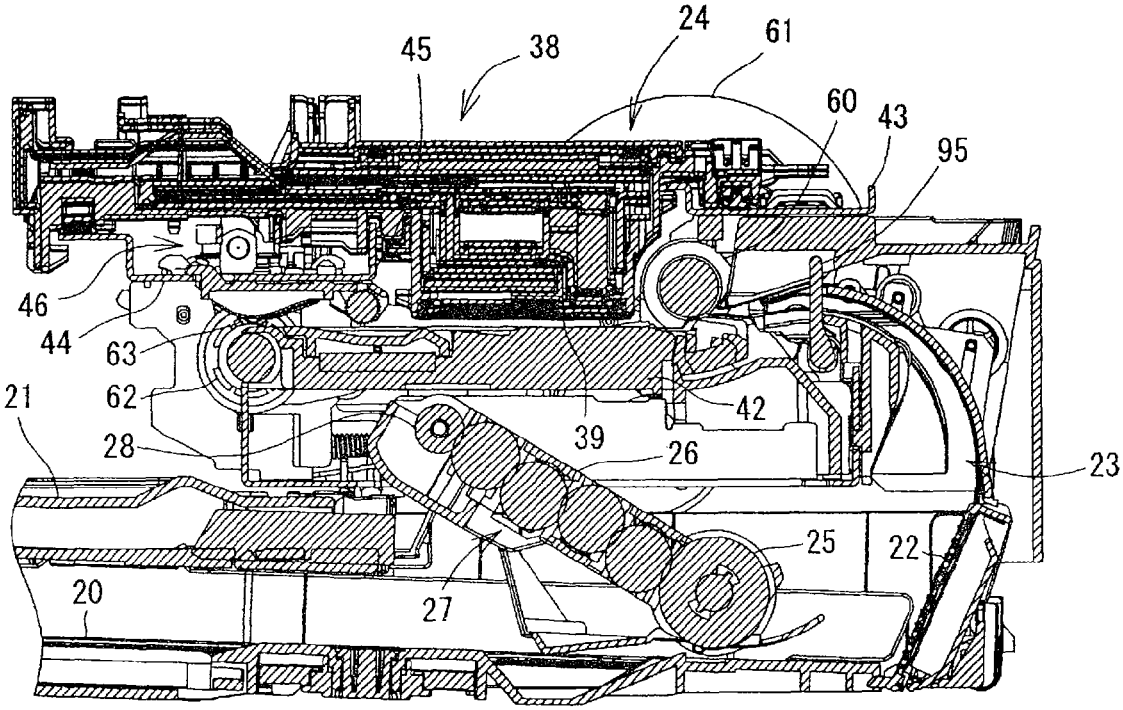
FIG. 3 is a partially enlarged view of the multi-function apparatus as the first embodiment of the present invention in cross section.

FIG. 3 is a partially enlarged view showing a main construction of the printer section 11 in cross section.

As shown in FIG. 3, a sheet-supply roller 25 is provided above the sheet-supply tray 20. The sheet-supply roller 25 is for supplying one of the recording sheets stacked on the sheet-supply tray 20 to the sheet-feed path 23. The sheet-supply roller 25 is supported by a free end of a sheet-supply arm 26. The sheet-supply roller 25 is driven so as to be rotated by a drive force of an LF motor 71 (shown in FIG. 5) via a drive-force transmitting mechanism 27. The drive-force transmitting mechanism 27 is constituted by including a plurality of gears meshing with each other.

The sheet-supply arm 26 is supported by a shaft 28. A basal end portion of the sheet-supply arm 26 is supported by the shaft 28 and is pivotable about the shaft 28 as a pivotal shaft. Thus, the sheet-supply arm 26 is pivotable upward and downward so as to move toward and away from the sheet-supply tray 20. However, the sheet-supply arm 26 is forced so as to pivot downward by a self-weight thereof or by a force of a spring, or the like. Thus, the sheet-supply arm 26 normally contacts the sheet-supply tray 20, and when the sheet-supply tray 20 is inserted into or pulled out of the multi-function apparatus 10, the sheet-supply arm 26 is retracted to an upper position thereof. The sheet-supply roller 25 is brought into pressing contact with the uppermost recording sheet in the sheet-supply tray 20 since the sheet-supply arm 26 is forced so as to pivot downward. In this state, the sheet-supply roller 25 is rotated, whereby the uppermost recording sheet is fed toward the slant sheet separator plate 22 owing to a friction force between a roller surface of the sheet-supply roller 25 and the recording sheet. The fed recording sheet abuts at its leading end on the slant sheet separator plate 22 and is guided upward so as to be fed into the sheet-feed path 23. When the uppermost recording sheet is fed by the sheet-supply roller 25, the recording sheet immediately below the uppermost recording sheet may be fed together with the uppermost sheet by friction or static electricity. However, the recording sheet fed together with the uppermost sheet is prevented from being fed by abutting contact with the slant sheet separator plate 22.

As shown in FIG. 3, the image recording unit 24 is disposed in the sheet-feed path 23. The image recording unit 24 includes a carriage 38 and an ink-jet recording head 39 as an example of a recording head. The ink-jet recording head 39 is mounted on the carriage 38. The carriage 38 reciprocates in a main scanning direction. In the multi-function apparatus 10, ink cartridges are disposed separately from the ink-jet recording head 39. It is noted that the ink cartridges are not shown in FIG. 3. To the ink-jet recording head 39, there are supplied inks of mutually different colors, i.e., cyan (C), magenta (M), yellow (Y), and black (Bk), from the respective ink cartridges through respective ink tubes 41 (shown in FIG. 4). While the carriage 38 reciprocates, the ink-jet recording head 39 selectively ejects the inks as fine ink droplets. As a result, an image is recorded on the recording sheet which is being fed on a platen 42.

3. Driving System of Recording Head

Figure 4:
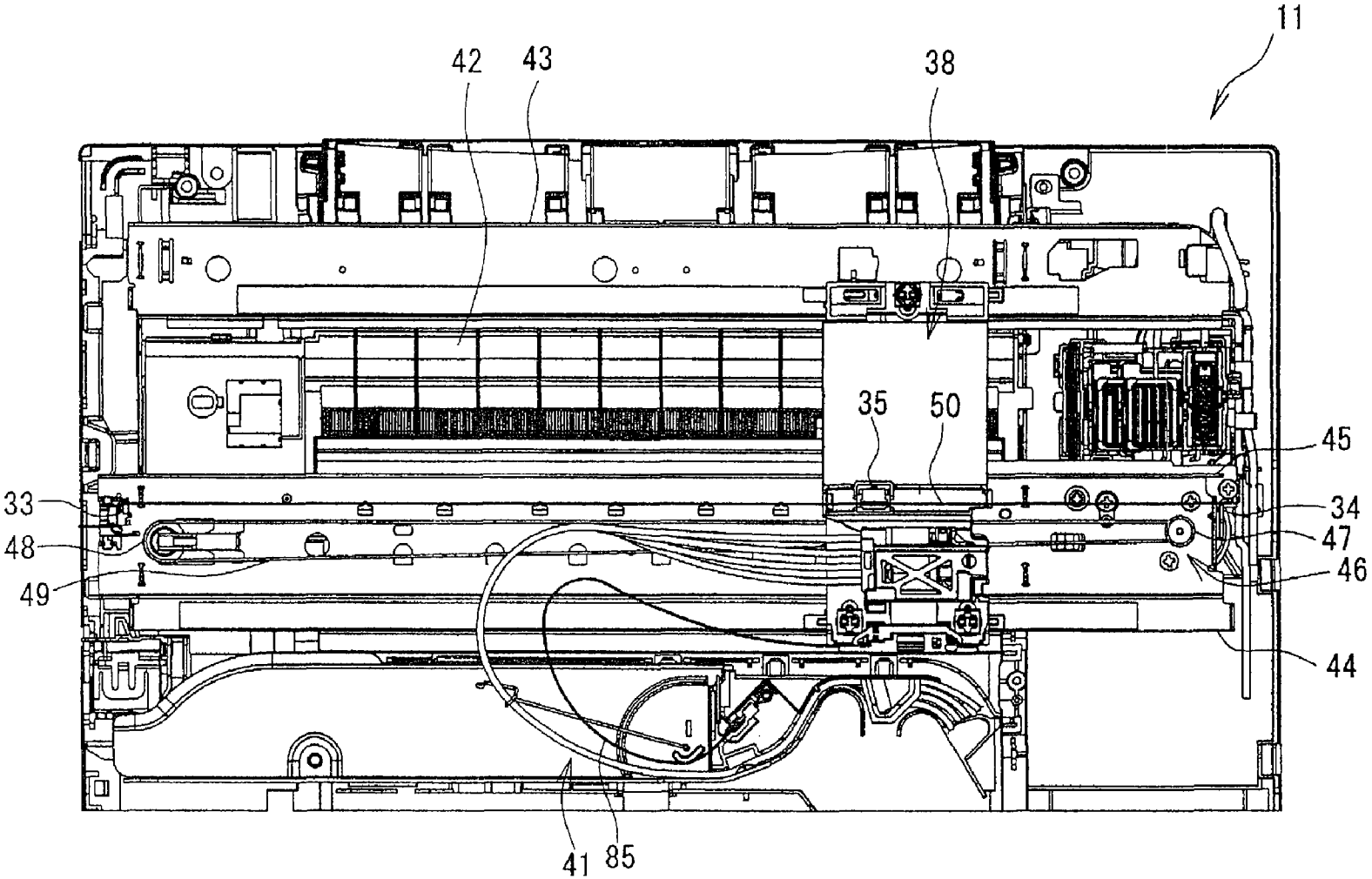
FIG. 4 is a plan view of a printer section of the multi-function apparatus as the first embodiment of the present invention.
Figure 5:
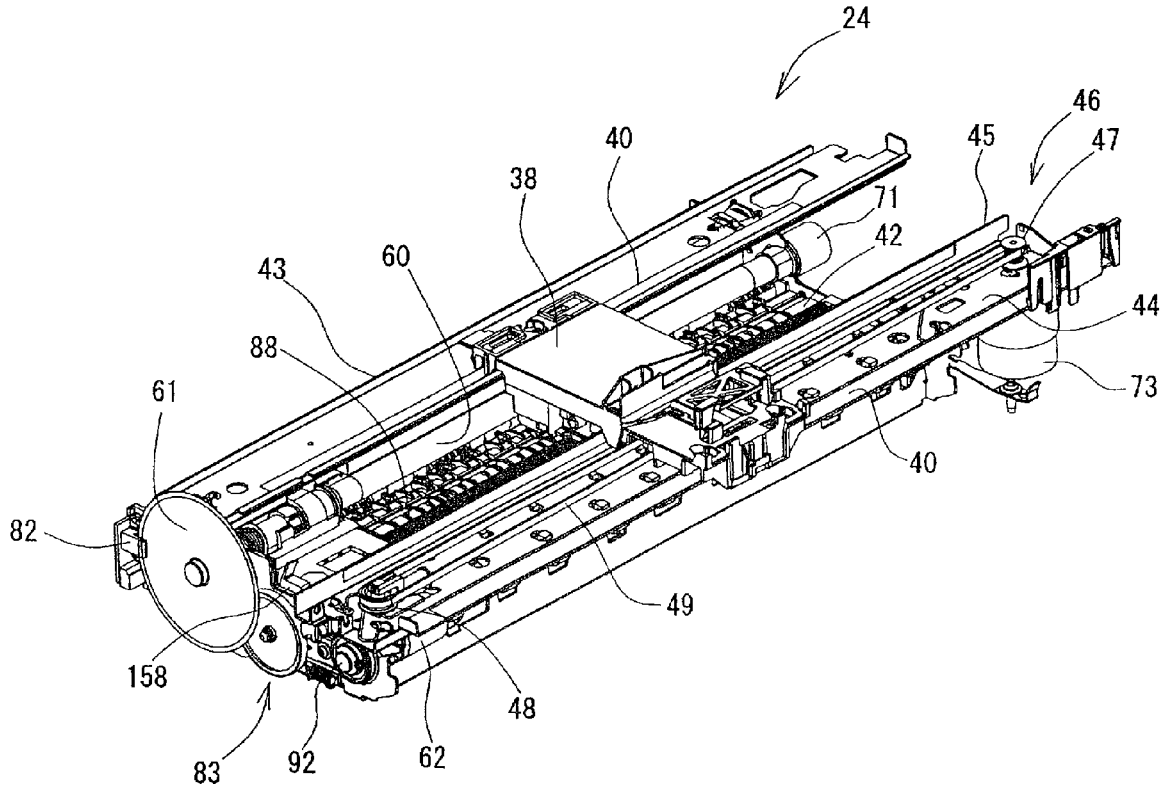
FIG. 5 is a perspective view of the printer section of the multi-function apparatus as the first embodiment of the present invention.

FIG. 4 is a plan view showing a main portion of the printer section 11. The figure mainly shows a construction of a middle portion through a rear portion of the printer section 11. FIG. 5 is a perspective view showing a main portion of the printer section 11. The figure shows a construction of the image recording unit 24.

As shown in FIGS. 4 and 5, above the sheet-feed path 23, a pair of guide rails 43, 44 are disposed. The guide rails 43, 44 are opposed to each other with a predetermined distance interposed therebetween in a feeding direction in which the recording sheet is fed (a direction extending from an upper side toward a lower side of the sheet of FIG. 4). The guide rails 43, 44 extend in a direction (a right and left direction in FIG. 4) perpendicular to the feeding direction in which the recording sheet is fed. The carriage 38 bridges between the guide rails 43, 44. That is, the carriage 38 slidably moves along the guide rails 43, 44 in a direction perpendicular to the feeding direction in which the recording sheet is fed.

A belt driving mechanism 46 is disposed on an upper surface of the guide rail 44. The belt driving mechanism 46 includes a drive pulley 47, a driven pulley 48, and an endless, annular timing belt 49. The drive pulley 47 and the driven pulley 48 are disposed near respective opposite ends of the sheet-feed path 23 in a width direction thereof. The timing belt 49 is tensioned between the drive pulley 47 and the driven pulley 48. The drive pulley 47 is driven by a CR motor 73 (shown in FIG. 5). The timing belt 49 is circulated by the rotation of the drive pulley 47.

The carriage 38 is fixed to the timing belt 49. Thus, the carriage 38 reciprocates on the guide rails 43, 44 on the basis of the circulation of the timing belt 49. As described above, the ink-jet recording head 39 is mounted on the carriage 38, so that the ink-jet recording head 39 reciprocates in the width direction of the sheet-feed path 23 as a main scanning direction, accompanying with the reciprocation of the carriage 38.

As shown in FIG. 4, an encoder strip 50 of a linear encoder 77 (shown in FIG. 8) is disposed on the guide rail 44. The encoder strip 50 has a shape like a band and is formed of a transparent resin. A pair of supporting portions 33, 34 are respectively formed on opposite end portions of the guide rail 44 (opposite end portions of the guide rail 44 in a direction in which the carriage 38 reciprocates). The opposite end portions of the encoder strip 50 are respectively engaged with the supporting portions 33, 34, so that the encoder strip 50 is provided along an edge portion 45 of the guide rail 44 while being held by the same 33, 34.

The encoder strip 50 includes light transmitting portions each of which transmits light and light intercepting portions each of which intercepts light. The light transmitting portions and the light intercepting portions are alternately arranged at predetermined pitches in a longitudinal direction of the encoder strip 50 so as to form a predetermined pattern. An optical sensor 35 of a transmission type is provided on an upper surface of the carriage 38. The optical sensor 35 is provided at a position corresponding to the encoder strip 50. The optical sensor 35 reciprocates with the carriage 38 in the longitudinal direction of the encoder strip 50. During the reciprocation, the optical sensor 35 detects the pattern of the encoder strip 50. The ink-jet recording head 39 includes a head control substrate for controlling an ink ejecting operation of the same 39. The head control substrate outputs pulse signals based on detection signals from the optical sensor 35. On the basis of the pulse signals, a position of the carriage 38 is recognized and the reciprocation of the carriage 38 is controlled. It is noted that since the head control substrate is covered with a head cover of the carriage 38, the head control substrate is not shown in FIGS. 4 and 5.

As shown in FIGS. 3 and 4, the platen 42 is provided below the sheet-feed path 23. The platen 42 is provided so as to be opposed to the ink-jet recording head 39. The platen 42 extends over a central portion of a reciprocation range of the carriage 38, through which central portion each recording sheet passes. A width of the platen 42 is sufficiently greater than the greatest one of respective widths of various types of feedable recording sheets. Opposite ends of the recording sheet in the feeding direction thereof pass over the platen 42. As described in greater detail below, the platen 42 is provided with a movable support member 88 (shown in FIG. 5) is provided. The movable support member 88 moves in the feeding direction so as to follow the recording sheet fed on the platen 42, and supports opposite end portions of the recording sheet which are opposed to each other in the feeding direction when the opposite end portions pass over the platen 42.

As shown in FIG. 1, on the front side of a case of the printer section 11, a door 97 is provided so as to be opened and closed. When the door 97 is opened, a cartridge mount portion exposes on the front side of the multi-function apparatus 10. The user can insert and remove the ink cartridges into and from the cartridge mount portion. Although not shown in the figure, the cartridge mount portion is partitioned into four accommodation chambers respectively corresponding to the ink cartridges. Each of the accommodation chambers of the cartridge mount portion can accommodate a corresponding one of the ink cartridges respectively storing the cyan, magenta, yellow, and black inks. The four ink tubes 41 respectively corresponding to the four inks are routed from the cartridge mount portion to the carriage 38 (as shown in FIG. 4). As described above, the four inks are supplied from the respective ink cartridges through the respective ink tubes 41 to the ink-jet recording head 39 mounted on the carriage 38.

As shown in FIG. 4, recording signals or the like are transmitted from a main substrate constituting a control section 64 (shown in FIG. 8) to the head control substrate of the ink-jet recording head 39 through a flat cable 85. The flat cable 85 electrically connects the main substrate and the head control substrate. It is noted that since the above-described main substrate is provided on the front side of the multi-function apparatus 10 (which is located on a lower portion of the sheet of FIG. 4), the main substrate is not shown in FIG. 4. The flat cable 85 is a thin belt-like cable that includes a plurality of electrically conductive wires each of which transmits electric signals, and a synthetic-resin-based film, such as a polyester film, that covers the electrically conductive wires to electrically insulate the same.

4. Structure of Recording Head

Figure 6:
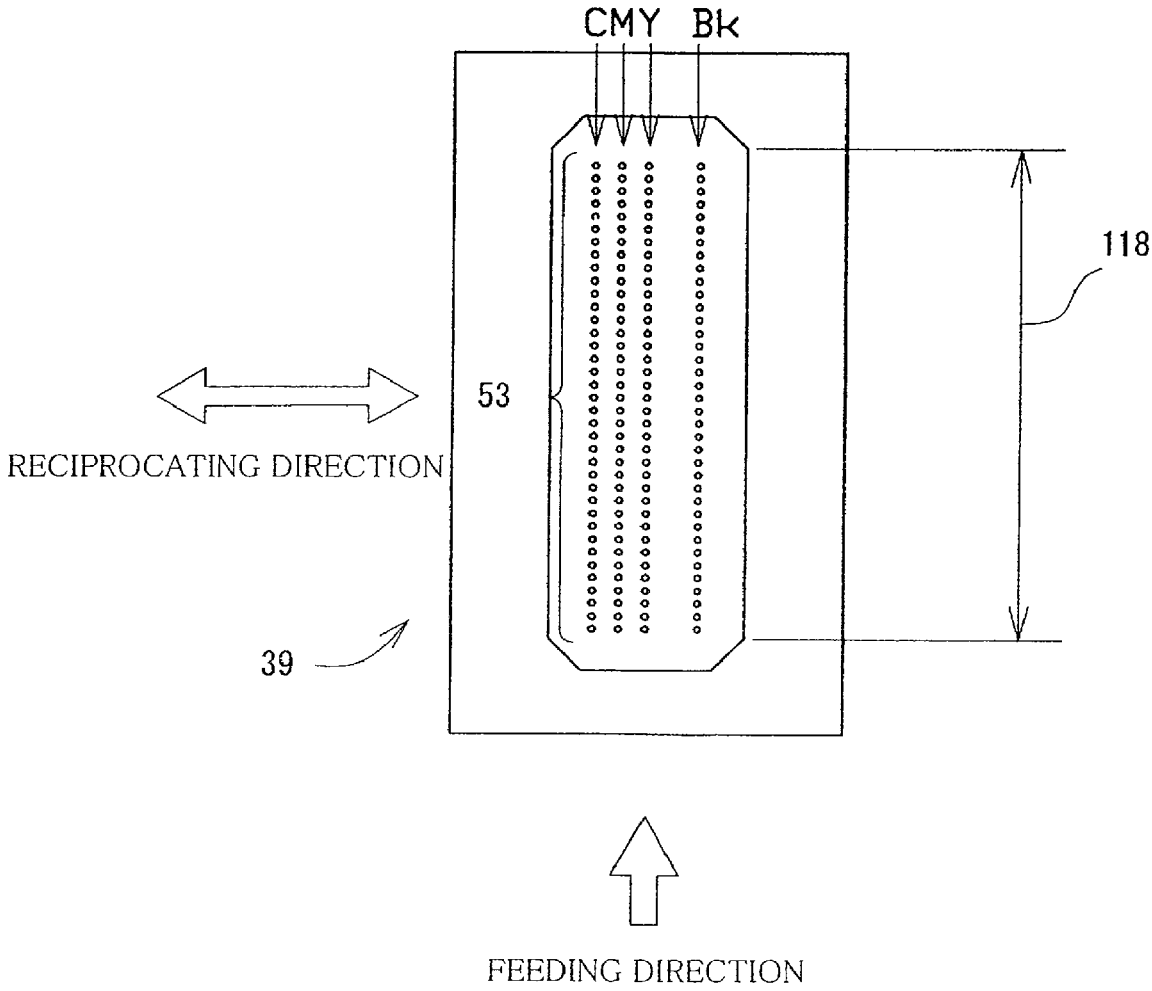
FIG. 6 is an enlarged bottom view of an ink-jet recording head of the multi-function apparatus as the first embodiment of the present invention.

FIG. 6 is a bottom view of the ink-jet recording head 39. The figure shows a nozzle formed surface of the ink-jet recording head 39.

As shown in the figure, nozzles 53 are formed in a lower surface of the ink-jet recording head 39. The nozzles 53 are arranged in rows in the feeding direction of the recording sheet in correspondence with the cyan (C), magenta (M), yellow (Y), and black (Bk) inks. It is noted that, in the figure, the upward direction corresponds to the feeding direction of the recording sheet, and the right and left direction corresponds to a reciprocating direction of the carriage 38. A plurality of the nozzles 53 each corresponding to one of the inks of the four colors, CMYBk, are arranged in rows in the feeding direction of the recording sheet. Further, the rows of the nozzles 53 each of which corresponds to one of the inks of the four colors are arranged in the reciprocating direction of the carriage 38. A pitch and a total number of the nozzles 53 in the feeding direction are suitably determined in accordance with resolution and the like of an image to be recorded. In addition, a total number of the rows of the nozzles 53 may be increased or decreased in accordance with a total number of types of color inks.

Figure 7:
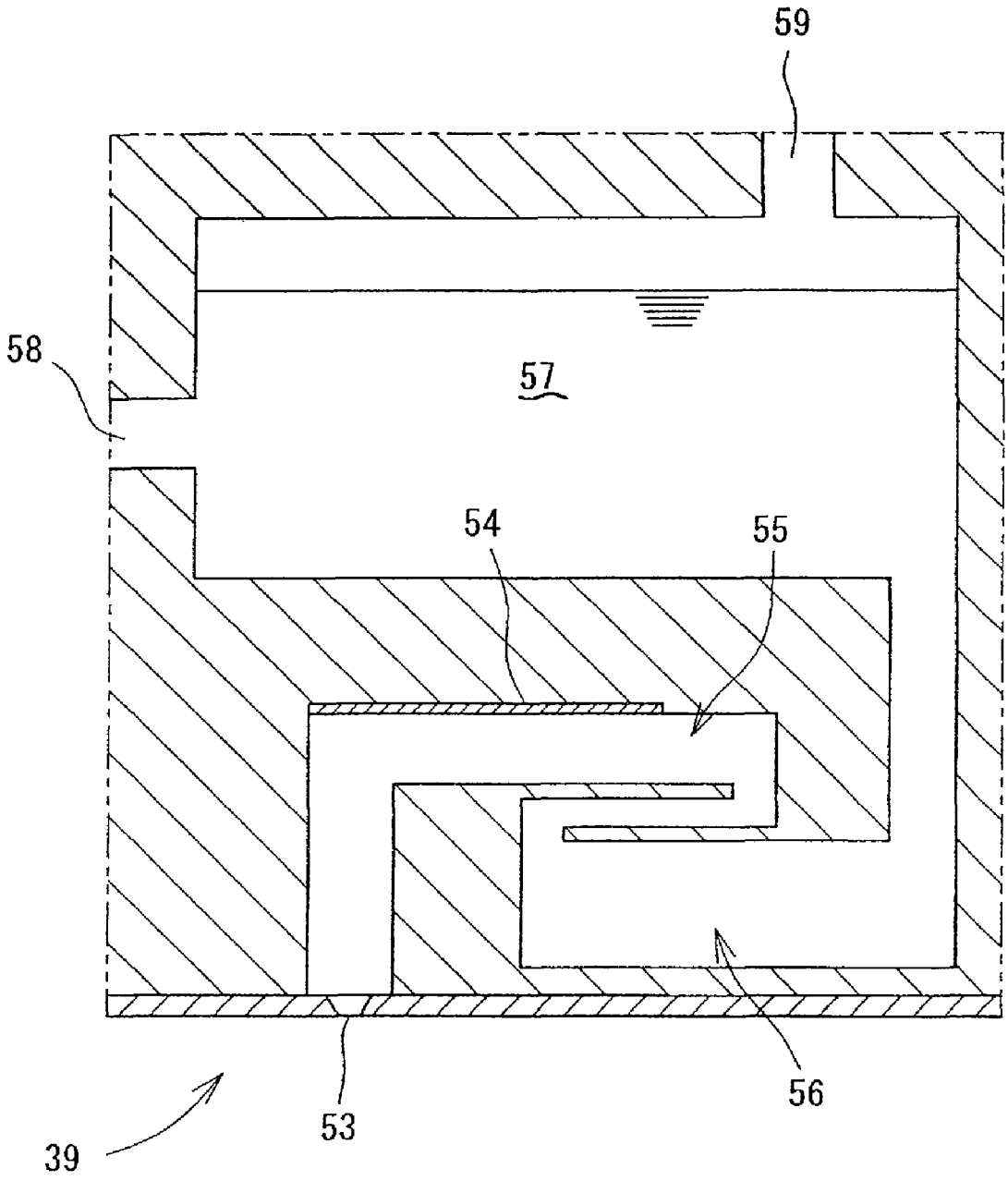
FIG. 7 is a partially enlarged view showing an internal construction of the ink-jet recording head in cross section.

FIG. 7 is a partially enlarged view showing an internal construction of the ink-jet recording head 39 in cross section.

As shown in the figure, cavities 55 respectively having piezoelectric elements 54 are formed on an upstream side of the nozzles 53 formed in the lower surface of the ink-jet recording head 39. The piezoelectric elements 54 are deformed by applying a predetermined voltage thereto so as to reduce volumes of the respective cavities 55. The volumes of the respective cavities 55 are thus changed, whereby the inks in the cavities 55 are ejected from the respective nozzles 53 as the ink droplets.

The cavities 55 are provided for the respective nozzles 53. Manifolds 56 are formed over a plurality of the cavities 55. The manifolds 56 are provided for the respective inks of the four colors, CMYBk. Buffer tanks 57 are disposed on an upstream side of the manifolds 56. The buffer tanks 57 are also provided for the respective inks of the four colors, CMYBk. The inks are supplied to the respective buffer tanks 57. The inks are supplied from respective ink supply holes 58 via the respective ink tubes 41. The buffer tanks 57 temporarily store the respective inks. Thus, air bubbles generated in the inks flowing through the ink tubes 41 or the like are separated from the inks, thereby preventing the air bubbles from entering the cavities 55 and the manifolds 56.

The inks of the four colors respectively supplied from the ink cartridges through the ink tubes 41 to the buffer tanks 57 are distributed from the respective buffer tanks 57 via the respective manifolds 56 to the corresponding cavities 55. The inks of the four colors, CMYBk, supplied through ink passages thus formed are ejected from the corresponding nozzles 53 onto the recording sheet as the ink droplets by the deformations of the piezoelectric elements 54.

5. Sheet Discharging System

As shown in FIG. 3, a sheet-feed roller 60 and a pinch roller are provided as a pair on an upstream side of the image recording unit 24 in the feeding direction. Hidden by other components, the pinch roller is not shown in FIG. 3, but is disposed so as to be held in pressing contact with a lower portion of the sheet-feed roller 60. Each recording sheet being fed in the sheet-feed path 23 is nipped and fed onto the platen 42 by the sheet-feed roller 60 and the pinch roller. Further, a sheet-discharge roller 62 and a spur roller 63 are provided as a pair on a downstream side of the image recording unit 24 in the feeding direction. Each recorded recording sheet is nipped and fed onto the sheet-discharge tray 21 by the sheet-discharge roller 62 and the spur roller 63. The LF motor 71 transmits a drive force to the sheet-feed roller 60 and the sheet-discharge roller 62. The sheet-feed roller 60 and the sheet-discharge roller 62 are intermittently driven, whereby each recording sheet is fed at predetermined line feed pitches. It is noted that the rotations of the sheet-feed roller 60 and the sheet-discharge roller 62 are synchronized with each other. A rotary encoder 76 (shown in FIG. 8) provided on the sheet-feed roller 60 detects, via an optical sensor 82 (shown in FIG. 5), a pattern of an encoder disc 61 which rotates with the sheet-feed roller 60. On the basis of thus detected detection signals, the rotations of the sheet-feed roller 60 and the sheet-discharge roller 62 are controlled.

The spur roller 63 is brought into pressing contact with each recorded recording sheet. A roller surface of the spur roller 63 has a plurality of projections and depressions like a spur so as not to deteriorate the image recorded on the recording sheet. The spur roller 63 is provided so as to be slidable and movable toward and away from the sheet-discharge roller 62. The spur roller 63 is forced by a coil spring so as to be brought into pressing contact with the sheet-discharge roller 62. When each recording sheet is fed into between the sheet-discharge roller 62 and the spur roller 63, the spur roller 63 is retracted against a forcing force of the coil spring by a distance corresponding to a thickness of the recording sheet. The recording sheet is pressed onto the sheet-discharge roller 62. Thus, a rotation force of the sheet-discharge roller 62 is reliably transmitted to the recording sheet. The above-described pinch roller is provided with respect to the sheet-feed roller 60 in a similar manner. Thus, each recording sheet is pressed on the sheet-feed roller 60, whereby a rotation force of the sheet-feed roller 60 is reliably transmitted to the recording sheet.

A register sensor 95 is disposed on an upstream side of the sheet-feed roller 60 in the sheet-feed path 23. The register sensor 95 includes a detecting element shown in FIG. 3 and an optical sensor, not shown. The detecting element is disposed across the sheet-feed path 23 and can project into and retract from the sheet-feed path 23. Normally, the detecting element is elastically forced so as to project into the sheet-feed path 23. Each recording sheet being fed in the sheet-feed path 23 is brought into contact with the detecting element, whereby the detecting element retracts from the sheet-feed path 23. The projection and retraction of the detecting element change an "ON" state and an "OFF" state of above-described optical sensor. Thus, the recording sheet causes the detecting element to project and retract, whereby the leading end and a trailing end of the recording sheet in the sheet-feed path 23 are detected.

In this multi-function apparatus 10, the LF motor 71 functions as a drive source for supplying each recording sheet from the sheet-supply tray 20. Further, the LF motor 71 functions as a drive source for feeding each recording sheet located on the platen 42 and for discharging, onto the sheet-discharge tray 21, each recorded recording sheet. That is, in addition to driving the sheet-feed roller 60 (as shown in FIG. 5), the LF motor 71 drives, as described above, the sheet-supply roller 25 via the above-described drive-force transmitting mechanism 27 (as shown in FIG. 3). Further, the LF motor 71 drives, via a specific drive-force transmitting mechanism 83 (shown in FIG. 5), a sheet-discharge roller shaft on which the sheet-discharge roller 62 is mounted.

6. Control System

Figure 8:
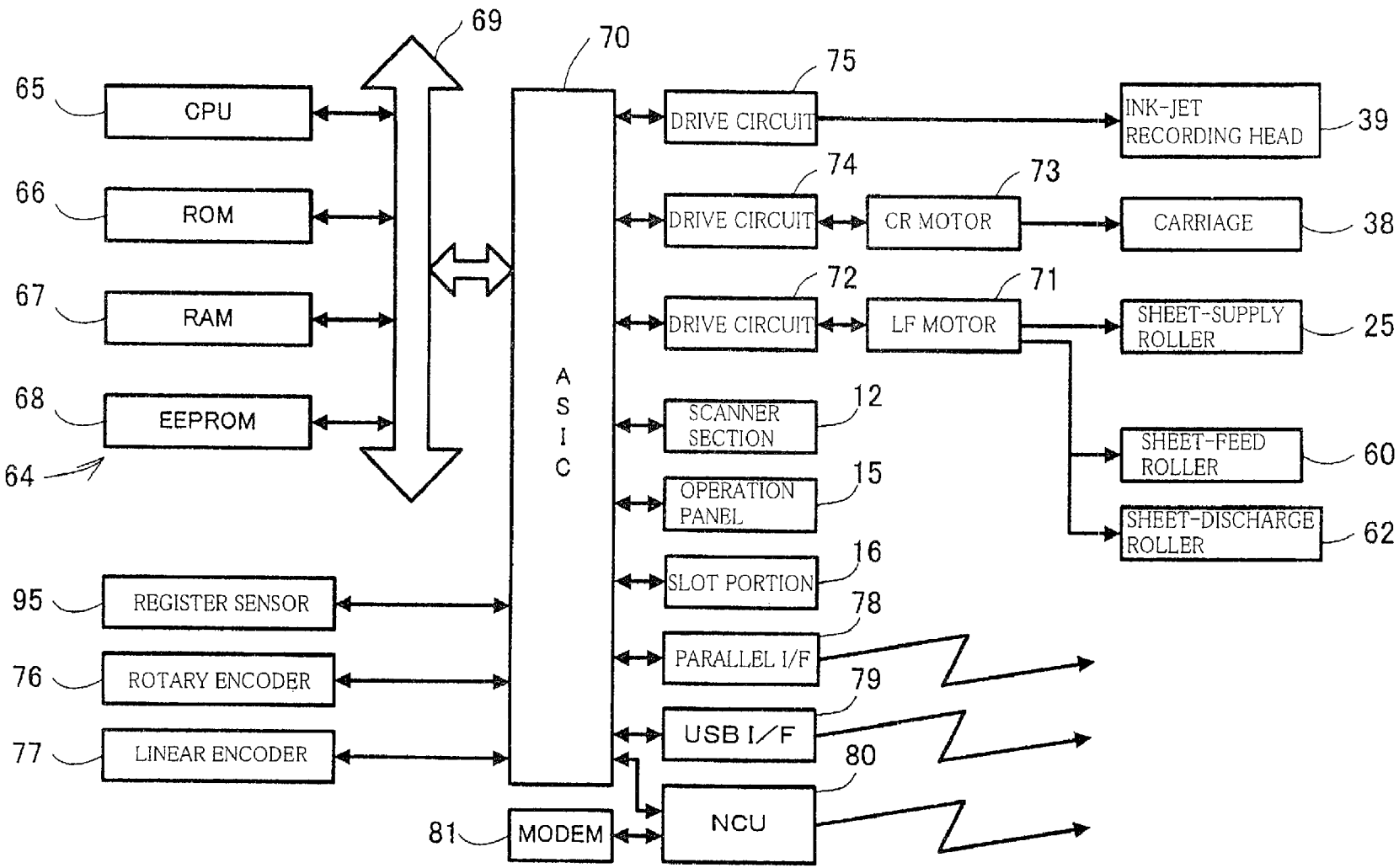
FIG. 8 is a block diagram showing a configuration of a control section of the multi-function apparatus as the first embodiment of the present invention.

FIG. 8 is a block diagram showing a configuration of the control section 64 of the multi-function apparatus 10.

The control section 64 controls not only the printer section 11 but also an entire operation of the multi-function apparatus 10 including the printer section 12. The control section 64 is constituted by the above-described main substrate connected to the flat cable 85. It is noted that a configuration relating to a control of the scanner section 12 is not a main configuration relating to the present invention, and a detailed explanation of which is dispensed with.

As shown in the figure, the control section 64 is configured as a microcomputer mainly including a CPU (Central Processing Unit) 65, a ROM (Read Only Memory) 66, a RAM (Random Access Memory) 67, and an EEPROM (Electrically Erasable and Programmable ROM) 68. The control section 64 is connected, via a bus 69, to an ASIC (Application Specific Integrated Circuit) 70.

The ROM 66 stores programs and the like for controlling various operations of the multi-function apparatus 10. The RAM 67 is used as a work area or a storage area in which to temporarily store various data used when the CPU 65 executes the above-mentioned programs. Further, the EEPROM 68 stores flags, settings, and the like which should be kept after turning a power off.

An ASIC 70 produces, on the basis of a command from the CPU 65, a phase excitation signal and the like for energizing the LF motor 71. The signal is transmitted to a drive circuit 72 of the LF motor 71, and a drive signal is transmitted, via the drive circuit 72, to the LF motor 71 for the energization. Thus, the rotation of the LF motor 71 is controlled.

The drive circuit 72 is for driving the LF motor 71 to which the sheet-supply roller 25, the sheet-feed roller 60, and the sheet-discharge roller 62 are connected. The drive circuit 72 receives an output signal from the ASIC 70 and produces an electric signal for rotating the LF motor 71. The LF motor 71 receives the electric signal to be rotated. A rotation force of the LF motor 71 is transmitted to the sheet-supply roller 25, the sheet-feed roller 60, and the sheet-discharge roller 62. It is noted that the rotation force of the LF motor 71 is transmitted to the sheet-supply roller 25 and the like through a known drive mechanism including gears and a drive shaft and so on. Thus, in the multi-function apparatus 10 as the present embodiment, the LF motor 71 functions, in addition to as the drive source for supplying each recording sheet from the sheet-supply tray 20, as the drive source for feeding each recording sheet located on the platen 42 and for discharging, onto the sheet-discharge tray 21, each recorded recording sheet.

The ASIC 70 produces, on the basis of a command of the CPU 65, a phase excitation signal and the like for energizing the CR motor 73. The signal is transmitted to a drive circuit 74 of the CR motor 73, and a drive signal is transmitted, via the drive circuit 74, to the CR motor 73 for the energization. Thus, the rotation of the CR motor 73 is controlled.

The drive circuit 74 is for driving the CR motor 73. The drive circuit 74 receives an output signal from the ASIC 70, and produces an electric signal for rotating the CR motor 73. The CR motor 73 receives the electric signal to be rotated. A rotation force of the CR motor 73 is transmitted to the carriage 38 through the belt driving mechanism 46, whereby the carriage 38 reciprocates. Thus, the reciprocation of the carriage 38 is controlled by the control section 64.

A drive circuit 75 is for driving the ink-jet recording head 39 at predetermined timings. The ASIC 70 produces an output signal on the basis of a drive control procedure outputted from the CPU 65. On the basis of this output signal, the drive circuit 75 controls the driving of the ink-jet recording head 39. The drive circuit 75 is mounted on the above-described head control substrate. A signal outputted from the drive circuit 75 is transmitted to the head control substrate via the flat cable 85 from the main substrate constituting the control section 64. Thus, the ink-jet recording head 39 selectively ejects the inks of the four colors onto each recording sheet at the predetermined timings.

To the ASIC 70, there are connected to the rotary encoder 76 which detects an amount of rotation of the sheet-feed roller 60, the linear encoder 77 which detects a position of the carriage 38, and the register sensor 95 which detects the leading end and the trailing end of each recording sheet. When a power of the multi-function apparatus 10 is turned on, the carriage 38 is moved to one of opposite ends of the guide rails 43, 44, and a detecting position detected by the linear encoder 77 is initialized. While the carriage 38 is moved from its initial position on the guide rails 43, 44, the optical sensor 35 (shown in FIG. 4) provided on the carriage 38 detects the pattern of the encoder strip 50. The control section 64 recognizes an amount of movement of the carriage 38 from a number of pulse signals based on the detection of the optical sensor 35.

The control section 64 controls the rotation of the CR motor 73 to control the reciprocation of the carriage 38 on the basis of the amount of movement thereof. Further, the control section 64 recognizes a position of the leading end or the trailing end of the recording sheet on the basis of a signal of the register sensor 95 and an encoded amount detected by the rotary encoder 76. When the leading end of the recording sheet reaches at a predetermined position of the platen 42, the control section 64 controls the rotation of the LF motor 71 to intermittently feed the recording sheet at the predetermined line feed pitches. These line feed pitches are set on the basis of a resolution and the like inputted as a condition of the image recording operation.

To the ASIC 70, there are connected the scanner section 12, the operation panel 15 for commanding the operations of the multi-function apparatus 10, the slot portion 16 into which a memory card of various small types is inserted, a parallel I/F 78 and a USB I/F 79 each for transmitting and receiving data to and from an external information device such as a personal computer via a corresponding one of a parallel cable and a USB cable, and so on. Further, an NCU (Network Control Unit) 80 and a modem (MODEM) 81 for realizing the facsimile function are also connected to the ASIC 70.

7. Structure of Platen

Figure 9:
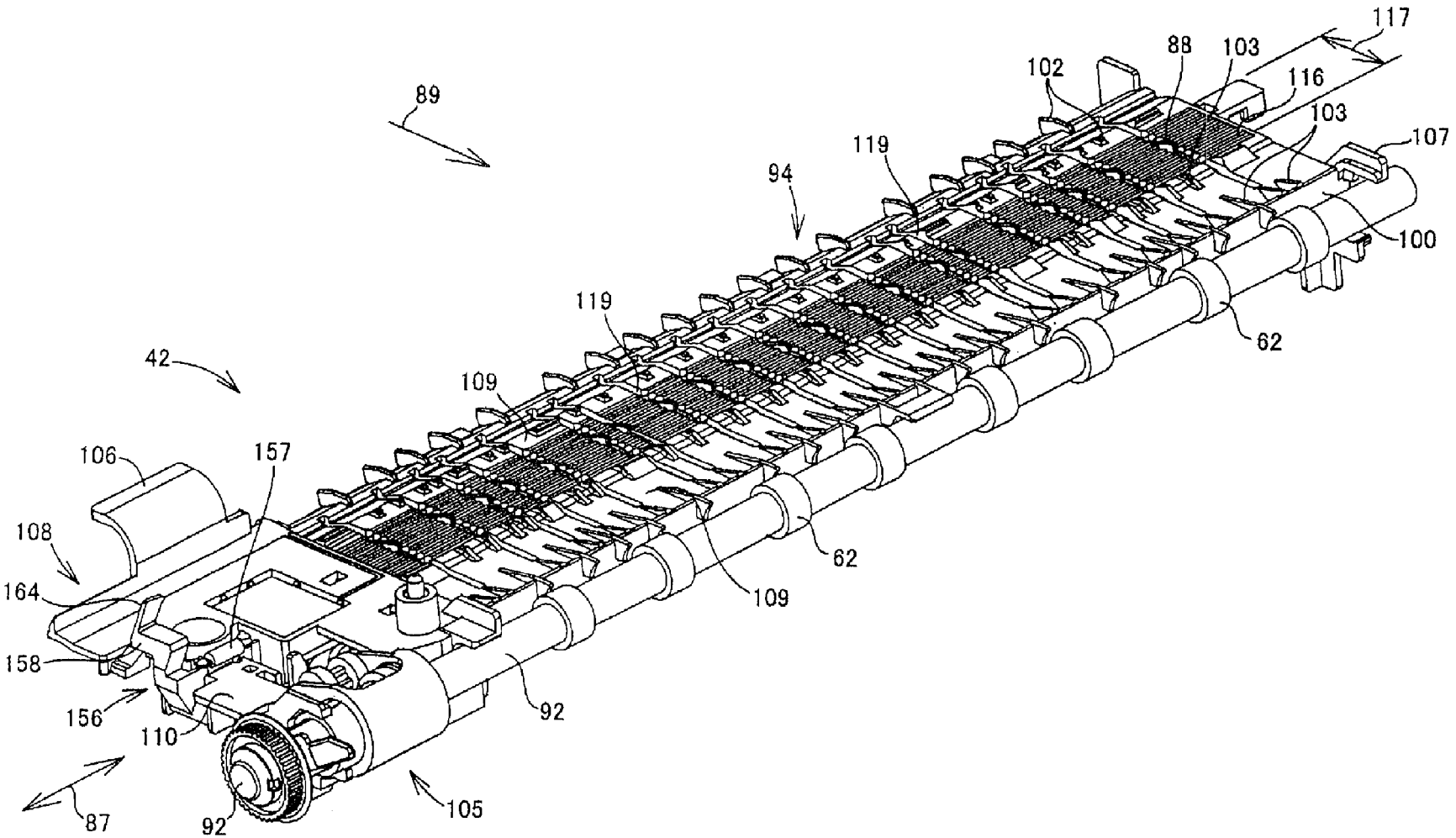
FIG. 9 is a fragmentary enlarged perspective view of FIG. 5.

FIG. 9 is a fragmentary enlarged perspective view of FIG. 5. The figure is an enlarged perspective view of the platen 42.

The platen 42 is, as described above, disposed (below the ink-jet recording head 39 in FIG. 3) so as to be opposed to the ink-jet recording head 39 and supports each recording sheet being fed. As shown in FIG. 9, the platen 42 has a thin, elongate, rectangular plate-like shape in its entirety. The platen 42 is disposed such that a longitudinal direction thereof extends along the above-described main scanning direction (i.e., a direction indicated by arrow 87). Further, in the figure, a direction indicated by arrow 89 is the above-described feeding direction. Each recording sheet is fed in the direction indicated by the arrow 89.

The platen 42 includes a frame 100, first fixed ribs 102 and second fixed ribs 103 provided on the frame 100, the movable support member 88 provided so as to be slidable relative to the frame 100, and a movement-linking mechanism 105 for driving the movable support member 88 to slide as described below.

The frame 100 is formed of a synthetic resin or steel plate, for example, and constitutes a structure frame of the platen 42. Brackets 106, 107 are provided on respective ends of the frame 100 which are opposed to each other in the main scanning direction. Each of the brackets 106, 107 is formed integrally with the frame 100. The frame 100 is fixed, through the brackets 106, 107, to the multi-function apparatus 10, more specifically, to the case of the printer section 11.

A driving mechanism installing portion 108 is provided on one of opposite end portions of the frame 100 (a left end portion thereof in FIG. 9). This driving mechanism installing portion 108 is formed integrally with the frame 100. The driving mechanism installing portion 108 includes an upper plate 110 continuous to an upper face 109 of the frame 100. The upper plate 110 has, as shown in the figure, a rectangular shape and supports the movement-linking mechanism 105 which will be described below.

The above-described first fixed ribs 102 and second fixed ribs 103 are provided on the upper face 109 of the frame 100. Specifically, the first fixed ribs 102 are provided on one of opposite end portions of the above-described upper face 109 which is located on an upstream side in the feeding direction, and project upward (toward the ink-jet recording head 39). On the other hand, the second fixed ribs 103 are provided on the other of opposite end portions of the above-described upper face 109 which is located on a downstream side in the feeding direction, and project upward. In the present embodiment, as shown in the figure, the first fixed ribs 102 and the second fixed ribs 103 are separated from each other in the feeding direction, but it should be understood that the first fixed ribs 102 and the second fixed ribs 103 may be formed integrally with each other.

In the present embodiment, a plurality of the first fixed ribs 102 are provided on the above-described upper face 109. The first fixed ribs 102 are arranged in a row in the main scanning direction. Likewise, a plurality of the second fixed ribs 103 are provided on the above-described upper face 109, and arranged in a row in the main scanning direction. The plurality of the first fixed ribs 102 and the plurality of the second fixed ribs 103 are thus arranged in respective rows, thereby forming a depressed area 116 between the first fixed ribs 102 and the second fixed ribs 103. The depressed area 116 extends in the above-described main scanning direction and spreads in the above-described feeding direction. A width 117 of the depressed area 116 corresponds to a size of the above-described ink-jet recording head 39. Specifically, the width 117 of the depressed area 116 is set so as to be greater than a width of an ink ejecting area 118 (shown in FIG. 6) of the ink-jet recording head 39.

As shown in the figure, the first fixed ribs 102 are respectively opposed to the second fixed ribs 103 in the feeding direction (the direction indicated by the arrow 89) with the above-described depressed area 116 interposed therebetween. Further, corner portions of each of the first fixed ribs 102 are chamfered so as to form inclined surfaces of the respective corner portions. In the present embodiment, the inclined surfaces are formed on the respective corner portions of each first fixed rib 102 which are opposed to each other in the feeding direction, but an inclined surface is enough to be formed at least on one of the corner portions which is on the upstream side in the feeding direction. Likewise, corner portions of each of the second fixed ribs 103 are chamfered so as to form inclined surfaces of the respective corner portions. The inclined surfaces are formed on the respective corner portions opposed to each other in the feeding direction also in each second fixed rib 103, but an inclined surface is enough to be formed at least on one of the corner portions which is on the upstream side in the feeding direction.

A plurality of slits 119 are provided in the upper face 109 of the above-described frame 100. The slits 119 are arranged in a row in the main scanning direction at predetermined pitches. As shown in the figure, each of the slits 119 extends in the feeding direction from the one end portion of the above-described upper face 109 which is on the upstream side in the feeding direction, to the other end portion of the same 109 which is on the downstream side. The slits 119 are formed such that one of the slits 119 extends between a position between corresponding two of the first fixed ribs 102 which are adjacent to each other and a position between corresponding two of the second fixed ribs 103 which are adjacent to each other. Portions of the above-described movable support member 88 are respectively fitted in the slits 119, thereby projecting from the respective slits 119.

Although not shown in the figure, the frame 100 includes an absorptive pad 98 and an absorptive pad 99 each as a second ink absorber (as shown in FIG. 17). These absorptive pads 98, 99 are formed of a nonwoven fabric, for example. As shown in FIG. 17, the absorptive pads 98, 99 have an elongate rod-like shape and are disposed on respective end portions of an inside of the frame 100. Specifically, the absorptive pad 98 is disposed on one of the end portions of the frame 100 on the upstream side in the feeding direction. When the movable support member 88 is, as described below, slid to a sheet-feeding-direction upstream end portion 94 which is an end portion located on the upstream side in the feeding direction, the movable support member 88 and the absorptive pad 98 contact each other. On the other hand, the absorptive pad 99 is disposed on the other of the end portions of the frame 100 on the downstream side in the feeding direction. When the movable support member 88 is slid to the end portion located on the downstream side in the feeding direction as described below, the movable support member 88 and the absorptive pad 99 contact each other. That is, the movable support member 88 contacts the absorptive pad 98 when the movable support member 88 is located at one of opposite ends of a sliding range thereof, and contacts the absorptive pad 99 when the movable support member 88 is located at the other of the opposite ends of the sliding range thereof.

8. Movable Support Member and Movement-linking Mechanism

Figure 10:
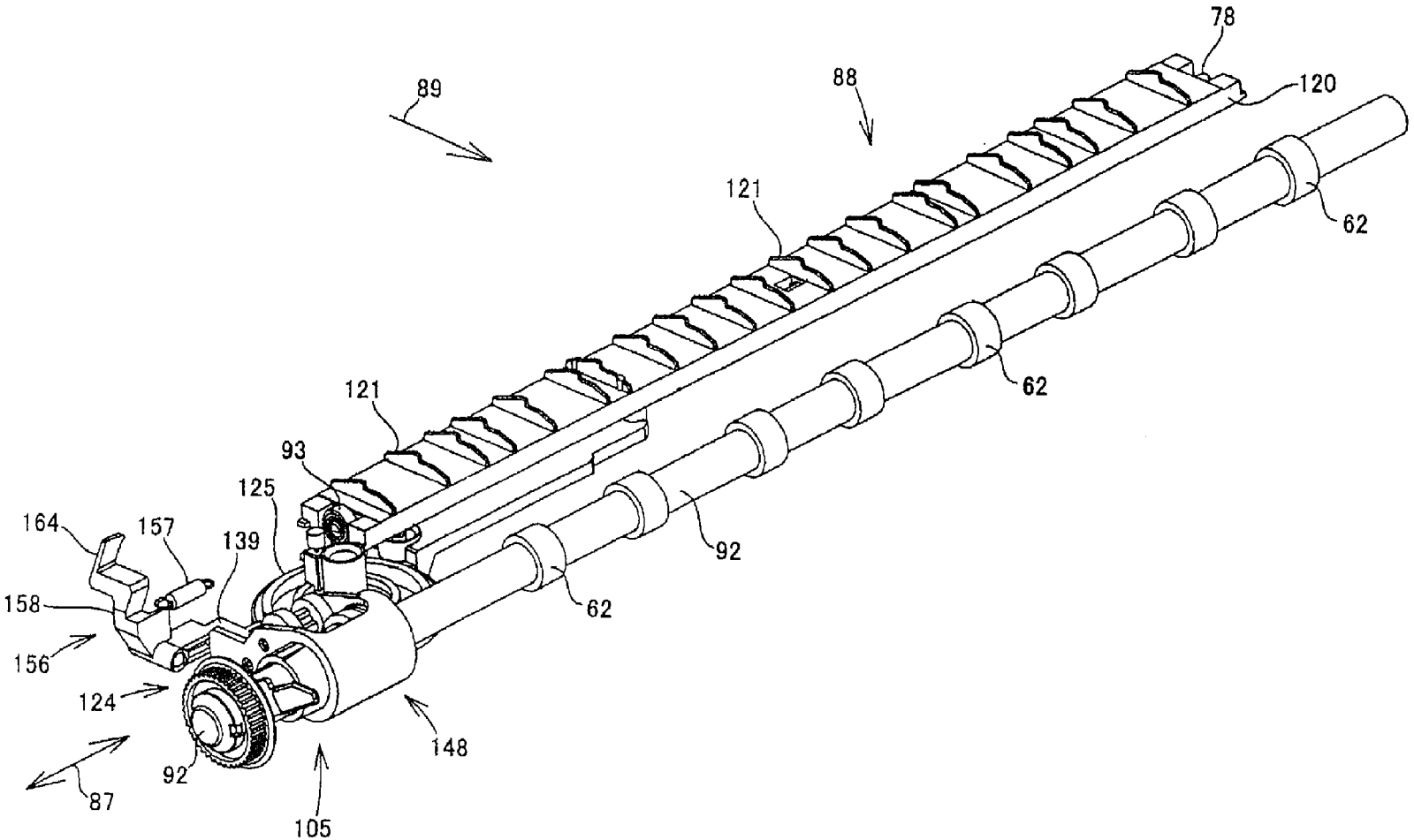
FIG. 10 is an enlarged perspective view of a movable support member of the multi-function apparatus as the first embodiment of the present invention.
Figure 11:
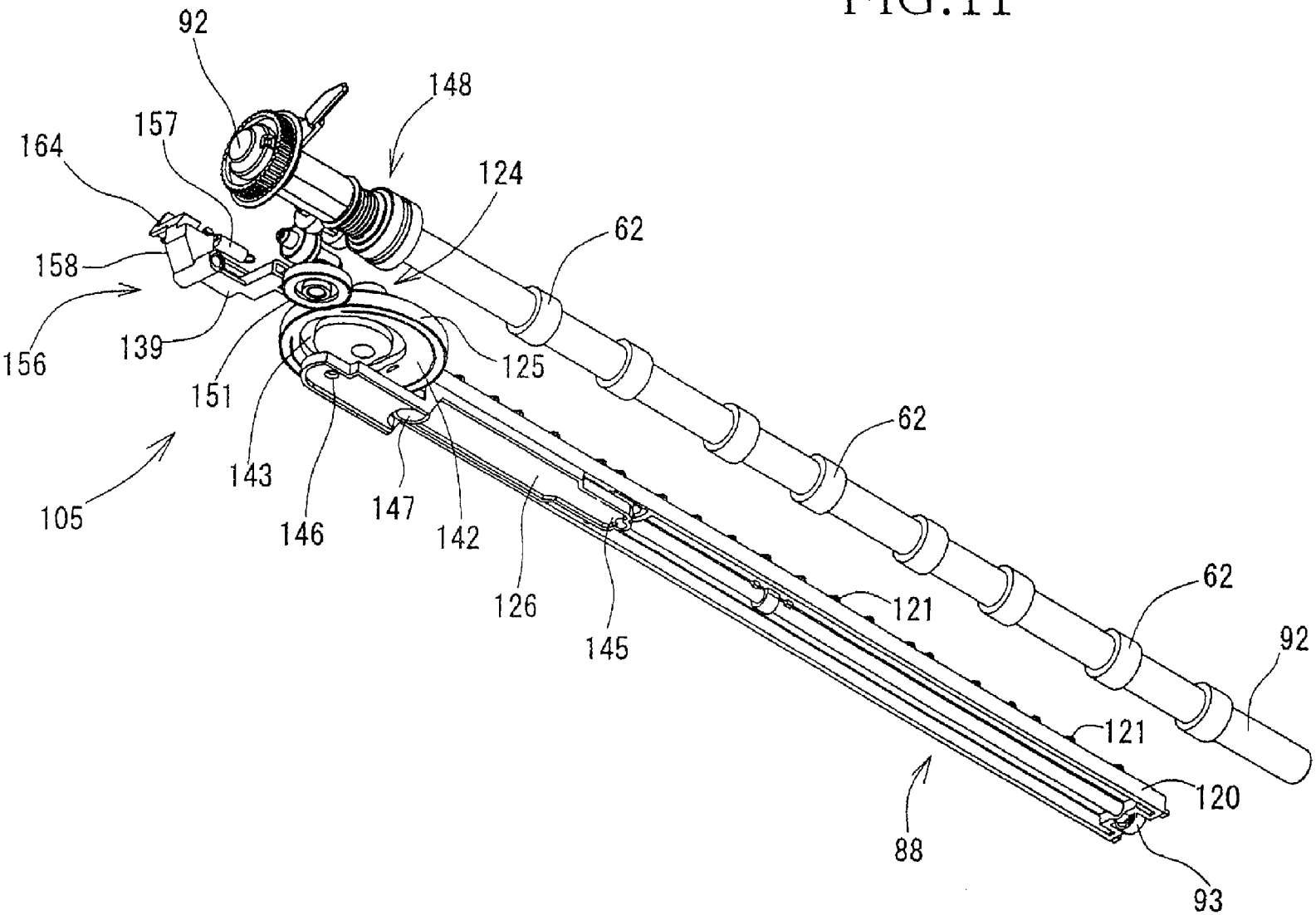
FIG. 11 is an enlarged perspective view of the movable support member of the multi-function apparatus as the first embodiment of the present invention.
Figure 12:
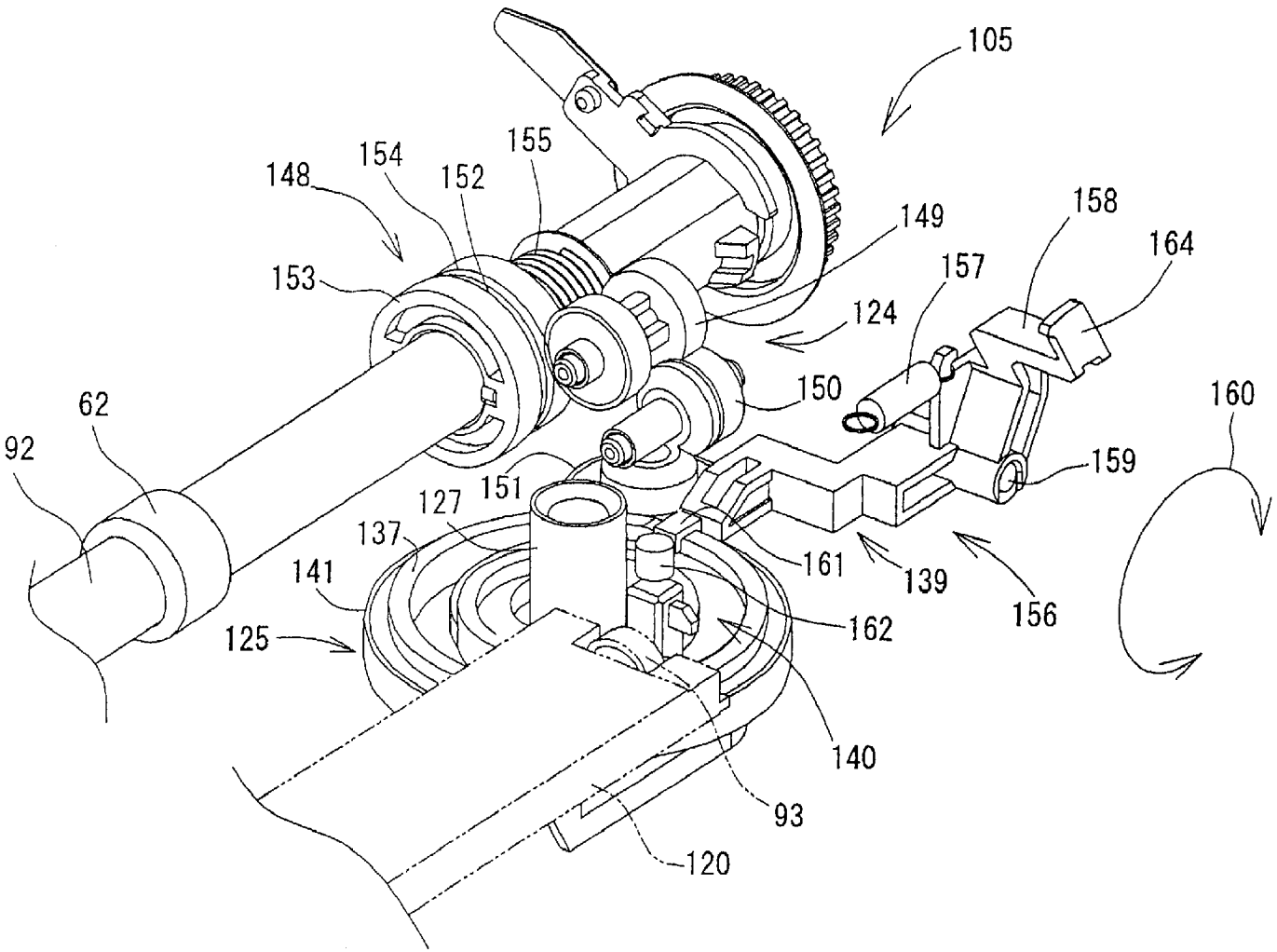
FIG. 12 is an enlarged perspective view of a movement-linking mechanism of the multi-function apparatus as the first embodiment of the present invention.

FIG. 10 is an enlarged perspective view of the movable support member 88. FIG. 11 is an enlarged perspective view of the movable support member 88 as seen from a bottom surface of the platen 42. FIG. 12 is an enlarged perspective view of the above-described movement-linking mechanism 105.

The movable support member 88 includes, as shown in FIGS. 10 and 11, a base 120 having a box-like shape, and ribs 121 provided fixedly to the base 120. Since the ribs 121 are moved together with the base 120 by sliding of the same 120 as described below, the ribs 121 will be hereinafter referred to as movable ribs 121. Each of the movable ribs 121 has a thin plate-like shape and projects from the platen 42 (as shown in FIG. 9). Each of the movable ribs 121 functions as a supporting portion of the movable support member 88 which supports the recording sheet. It is noted that illustrations of the movable ribs 121 are omitted in FIG. 12.

The movable support member 88 may be formed of a synthetic resin or a metal. The base 120 has an elongate plate shape in its entirety. The base 120 is, as shown in FIG. 9, fitted in the inside of the frame 100 from below. As shown in FIG. 10, slide rollers 93 are provided on respective end portions of the base 120 which are opposed to each other in the main scanning direction. It is noted that an illustration of one of the slide rollers which is located on a right side of the figure is omitted, and one of support pins 78 for supporting the slide roller is illustrated. Each of the slide rollers 93 is provided rotatably to the base 120, so as to smoothly roll on the above-described frame 100. Thus, the base 120 can smoothly slide in the feeding direction (the direction indicated by the arrow 89 in FIGS. 9 and 10) inside the above-described frame 100.

As shown in FIG. 10, the movable ribs 121 are provided over an upper face of the base 120. The movable ribs 121 are formed integrally with the base 120. Each of the movable ribs 121 has a polygonal shape. The shape of each movable rib 121 will be described below in detail. In the present embodiment, a plurality of the movable ribs 121 are provided over the upper face of the base 120. Each of the movable ribs 121 has a planar plate shape extending in the feeding direction and is provided vertically or erectly relative to the upper face of the base 120. The movable ribs 121 are arranged at predetermined spaces in the main scanning direction (the direction indicated by the arrow 87 in FIG. 10). The predetermined spaces correspond to the pitches of the above-described slits 119 (shown in FIG. 9). Thus, the movable ribs 121 are projected from the upper face 109 of the frame 100 through the respective slits 119 provided in the frame 100.

Figure 13:
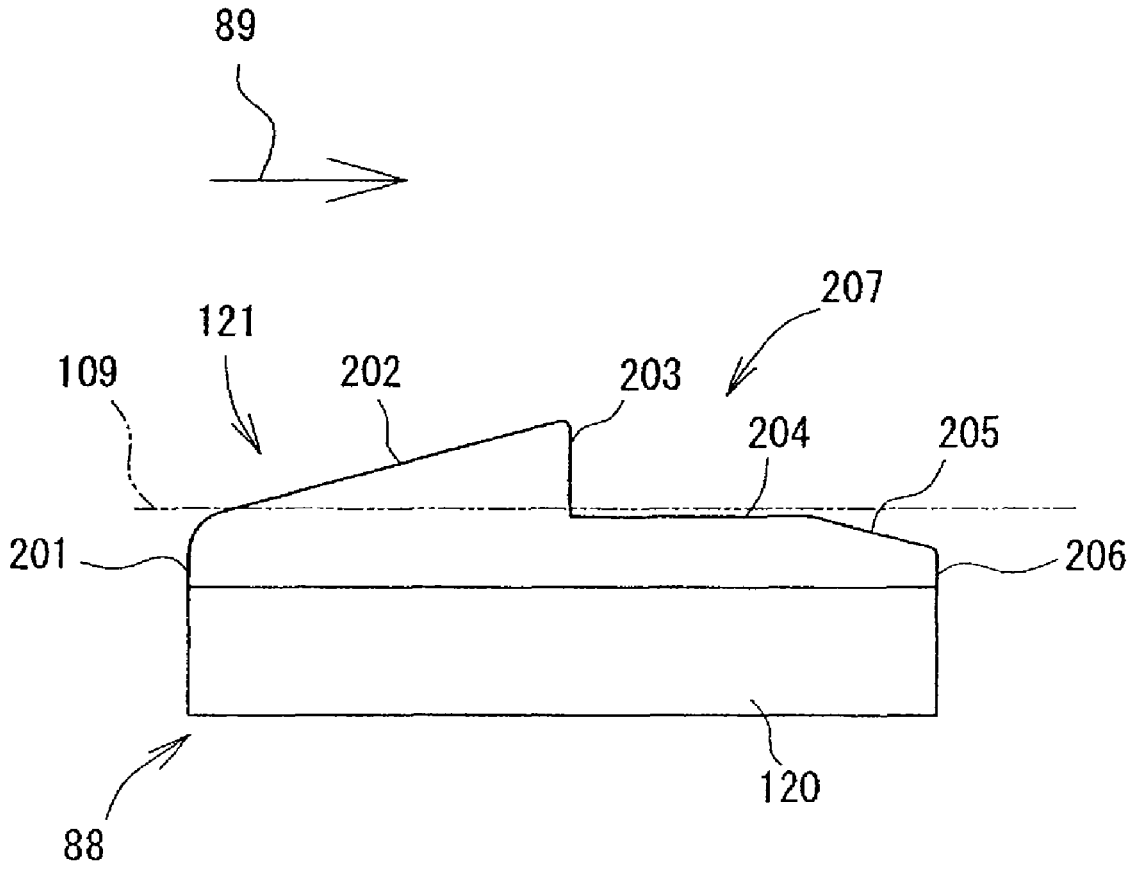
FIG. 13 is an enlarged side view of a movable rib of the multi-function apparatus as the first embodiment of the present invention.

FIG. 13 is an enlarged side view of one of the movable ribs 121. In the figure, a two-dot chain line indicates a position of the upper face 109 of the frame 100. Further, the arrow 89 indicates the feeding direction of the recording sheet.

In the present embodiment, each movable rib 121 included in the movable support member 88 has a septagonal shape in a side elevational view. That is, each movable rib 121 includes a front end face 201, a front slant face 202, a vertical wall face 203 as a transfer preventing face, and a horizontal face 204 as an ink receiving face. A rear slant face 205 and a rear end face 206 are continuous to the horizontal face 204. The above-described vertical wall face 203 and horizontal face 204 are at right angles to each other so as to form a step portion 207 in a downstream portion of the movable support member 88 in the feeding direction. The step portion 207 is lower in height than a top part of each movable rib 121 which is adjacent to the step portion 207, in other words, one of end parts of the front slant face 202 which one is a part that supports the recording sheet and is located on the downstream side in the feeding direction. It is noted that each of a boundary between the front end face 201 and the front slant face 202, a boundary between the front slant face 202 and the vertical wall face 203, a boundary between the horizontal face 204 and the rear slant face 205, and a boundary between the rear slant face 205 and the rear end face 206 is provided by a curved surface.

Since the above-described step portion 207 is formed, if the ink droplets adhere to the vertical wall face 203 or the horizontal face 204, the ink cannot easily transfer upward owing to gravity acting on the ink. In the present embodiment, the vertical wall face 203 and the horizontal face 204 are at right angles to each other, but the horizontal face 204 may not be at right angles to the vertical wall face 203 so long as the ink is restricted to transfer upward. Further, the ink droplets ejected from the ink-jet recording head 39 fly downward in the figure. On the other hand, the above-described horizontal face 204 is disposed in a generally horizontal direction. Thus, the above-described horizontal face 204 is perpendicular to a direction in which the ink droplets fly, whereby the horizontal face 204 can reliably receive the ink droplets flown from above. Further, by providing the horizontal face 204 as described above, a head gap with respect to the horizontal face 204 can be adjusted over an entire region of the step portion 207. That is, a height of the horizontal face 204 partly constituting the step portion 207 can be set such that an ink mist is not generated.

The movement-linking mechanism 105 is, as described above, for causing the movable support member 88 to slide in the feeding direction. As shown in FIG. 10, this movement-linking mechanism 105 is disposed between a sheet-discharge roller shaft 92 and the movable support member 88. By providing the movement-linking mechanism 105, the movable support member 88 moves while being linked to the sheet-discharge roller shaft 92. The movable support member 88 is moved while following the recording sheet so as to constantly support one of end portions of the recording sheet being fed on the platen 42 (specifically, one of end portions in the feeding direction). Specifically, when the recording sheet is fed to the sheet-feeding-directional upstream end portion 94 (shown in FIG. 9) of the frame 100 of the platen 42, the above-described movable ribs 121 are moved to the sheet-feeding-directional upstream end portion 94 so as to get nearer to the recording sheet. Thereafter, the movable ribs 121 are slid toward the downstream side in the feeding direction while supporting the recording sheet as the recording sheet is fed. A manner of the sliding of the movable support member 88 will be described below in detail.

As shown in FIG. 12, the movement-linking mechanism 105 includes a rotating plate 125 and a lever member 126 (shown in FIGS. 10 and 11) for changing a rotational movement of the rotating plate 125 to a translational movement of the movable support member 88. The lever member 126 is disposed between the rotating plate 125 and the movable support member 88. The above-described sheet-discharge roller shaft 92 is a drive source of the rotating plate 125. The rotating plate 125 is driven to be rotated through a drive-force transmitting mechanism 124.

Figure 14:
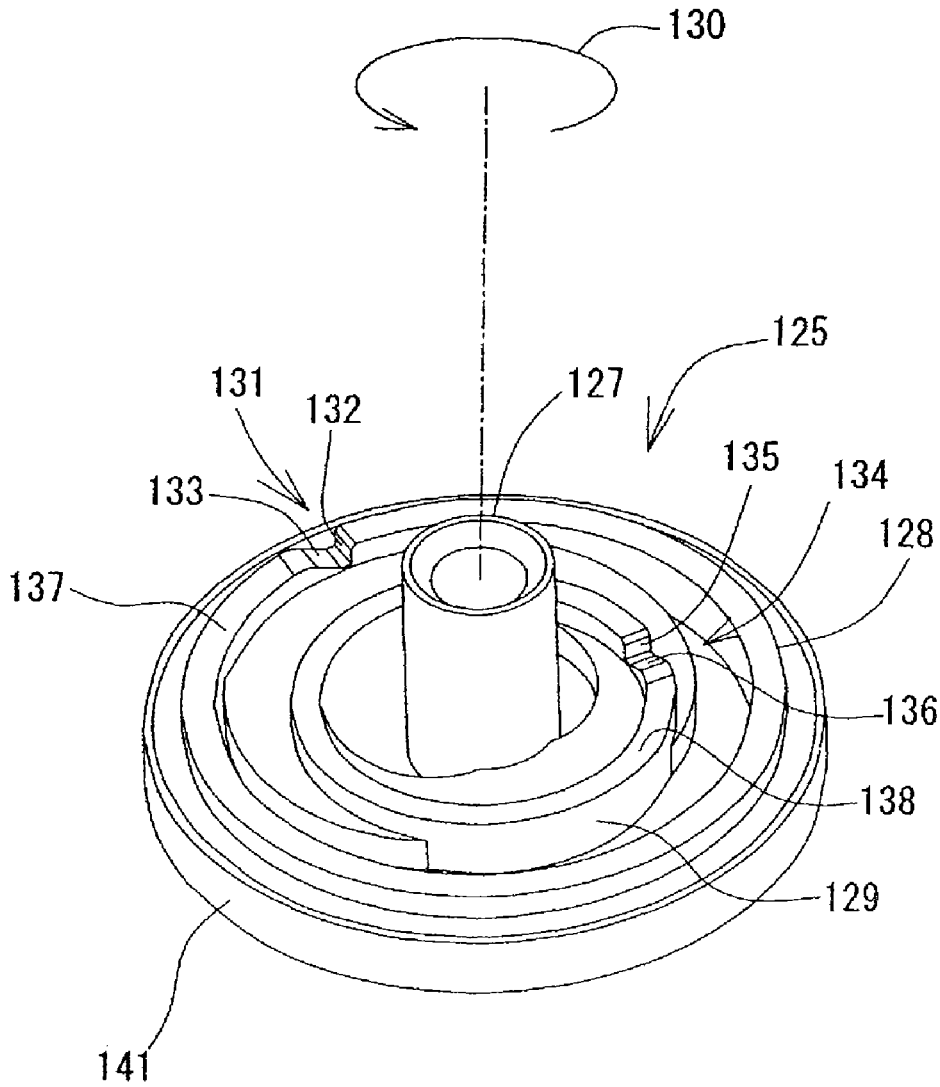
FIG. 14 is an enlarged perspective view of a rotating plate of the multi-function apparatus as the first embodiment of the present invention.
Figure 15:
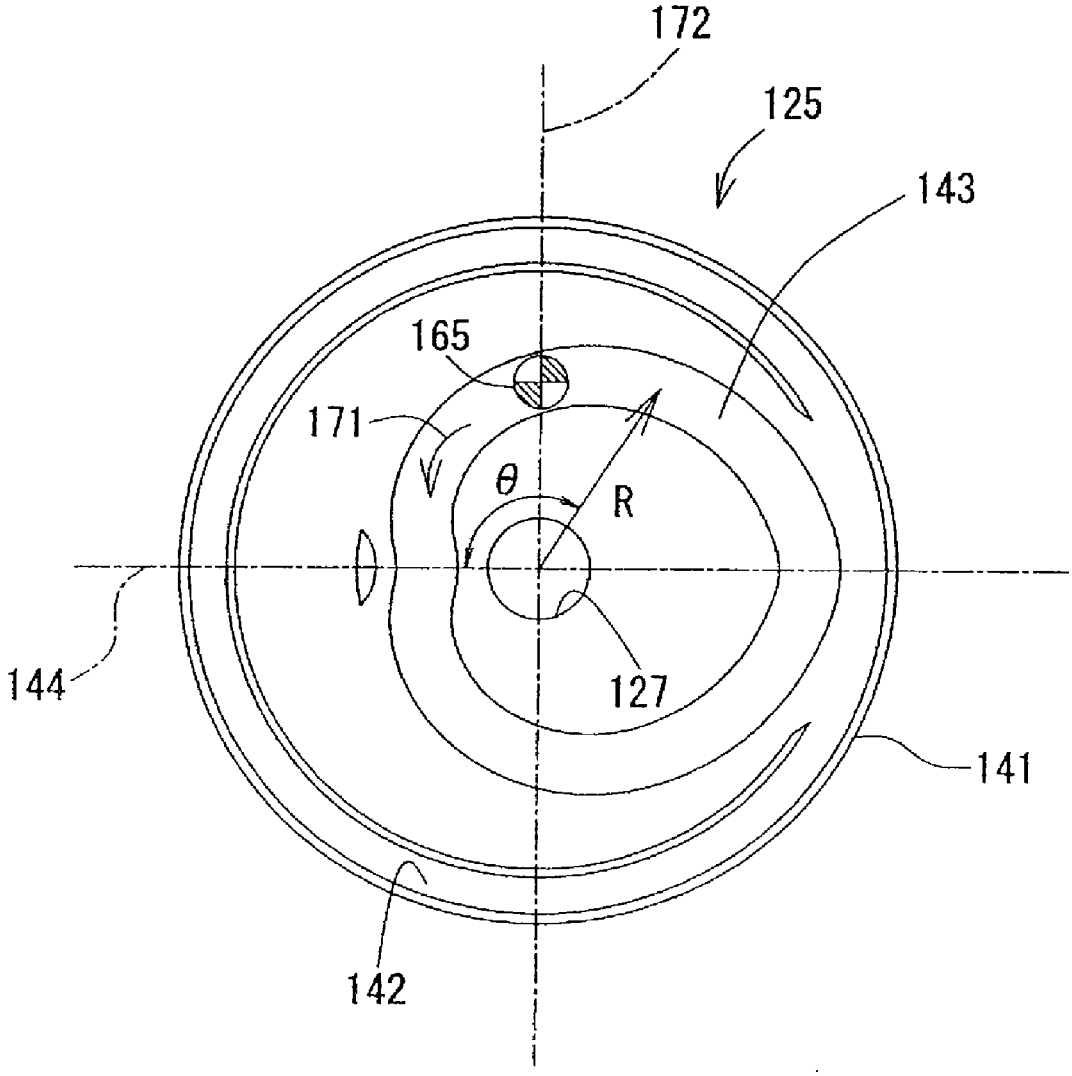
FIG. 15 is a bottom view of the rotating plate of the multi-function apparatus as the first embodiment of the present invention.

FIG. 14 is an enlarged perspective view of the rotating plate 125. FIG. 15 is a bottom view of the rotating plate 125.

As shown in FIGS. 12 and 14, the rotating plate 125 has a disc-like shape. The rotating plate 125 may be formed of a resin or a metal. The rotating plate 125 includes a round disc portion 141 and a cylindrical shaft 127 erectly provided in a center of an upper face of the disc portion 141. This cylindrical shaft 127 is rotatably supported by the frame 100 of the platen 42. Specifically, a rotational central shaft (not shown) is erectly provided on the above-described frame 100, for example. In this case, this rotational central shaft extends in a direction perpendicular to both of the above-described main scanning direction and the above-described feeding direction. The above-described cylindrical shaft 127 is rotatably fitted on the rotational central shaft. It is noted that the above-described cylindrical shaft 127 may be directly fitted in the frame 100. Ribs 128, 129 are erectly provided on an upper face of the rotating plate 125. The rib 129 has a rectangular shape in a cross-sectional view. The rib 129 is annular about the shaft 127. Further, the rib 128 also has a rectangular shape in a cross-sectional view. The rib 128 is annular about the shaft 127 to surround the rib 129.

The rotating plate 125 is forwardly or reversely rotated through the drive-force transmitting mechanism 124 described below, with a direction indicated by arrow 130 being as a forward direction. As shown in FIG. 14, a generally V-shaped notch 131 is provided in the rib 128. The notch 131 forms two wall faces. One of the wall faces is a forward rotation restricting face 132 that extends in an axial direction of the above-described shaft 127, that is, in a direction perpendicular to a direction in which the rotating plate 125 rotates. The other of the wall faces is a reverse rotation allowing face 133 that is continuous to an upper face 137 of the rib 128 while extending forwardly in a circumferential direction of the rib 128 from a lower edge of the forward rotation restricting face 132.

A generally V-shaped notch 134 is provided similarly in the rib 129. The notch 134 includes two wall faces. One of the wall faces is a reverse rotation restricting face 135 that extends in the axial direction of the above-described shaft 127, that is, in the direction perpendicular to the direction in which the rotating plate 125 rotates. The other of the wall faces is a forward rotation allowing face 136 that is continuous to an upper face 138 of the rib 129 while extending reversely in a circumferential direction of the rib 129 from a lower edge of the reverse rotation restricting face 135. With the notch 131 and the notch 134, there are respectively engaged a lock member 139 and a lock member 140 (shown in FIG. 12) as a rotation restricting means 156 described below. Engaging of the lock member 139 with the above-described notch 131 restricts the forward rotation of the rotating plate 125, while engaging of the lock member 140 with the notch 134 restricts the reverse rotation of the rotating plate 125.

As shown in FIGS. 11 and 15, a guide groove 143 is provided in a back face 142 of the rotating plate 125. This guide groove 143 is formed so as to depict a predetermined trailing curve. A shape of the guide groove 143 is, in FIG. 15, described in a polar coordinate with its origin at a center of the above-described cylindrical shaft 127. That is, in the figure, where a virtual axis 144 extending in a horizontal direction along the above-described back face 142 is set, the above-described guide groove 143 is formed along a trailing curve that satisfies the following formula, $k\theta+\alpha$ ($k$, $\alpha$: constant). In this case, an angle extending toward the left side of the virtual axis 144 from the origin is designed to be $\theta=0$, while a clockwise direction about the origin is designed to be a positive direction of the angle $\theta$. This trailing curve depicts an Archimedean spiral. A distance R between the origin and a center of the guide groove 143, and the above-described angle $\theta$ are in a linear relation. However, in the present embodiment, the range of the angle $\theta$ according to the formula, $R=k\theta+\alpha$, providing the trailing curve is $0° \leqq \theta \leqq 180°$, and a trailing curve having the same shape as the trailing curve formed in this range is disposed on an opposite side of the above-described virtual axis 144 so as to form a bi-laterally symmetrical shape (in a vertically symmetrical shape in the figure) about the same 144. Thus, the above-described guide groove 143 is formed according to the Archimedean spirals which are vertically symmetrical about the above-described virtual axis 144.

As shown in FIG. 11, the above-described lever member 126 has an elongate rod shape. The lever member 126 is attached to the base 120 of the above-described movable support member 88. Specifically, a distal end portion 145 of the lever member 126 is fitted in a back face of the above-described base 120 while the basal end portion 146 of the lever member 126 is fitted in the guide groove 143 (shown in FIG. 15) of the above-described rotating plate 125. This lever member 126 is supported at its intermediate portion 147 by the frame 100 of the platen 42. A supporting structure of the lever member 126 with respect to the frame 100 of the platen 42 is not shown in the figure. However, as the supporting structure, there may be employed a structure in which the above-described intermediate portion 147 is pivotably fitted on a support shaft (not shown) provided on the frame 100, for example.

The basal end portion 146 of the lever member 126 is fitted in the guide groove 143 of the rotating plate 125, thereby being displaceable along the guide groove 143. On the other hand, the distal end portion 145 of the lever member 126 is fitted in the above-described base 120, thereby being allowed to be displaced relative to the base 120 in the main scanning direction. Thus, upon rotating of the rotating plate 125, the basal end portion 146 of the lever member 126 is guided to the above-described guide groove 143. That is, the lever member 126 swings about the intermediate portion 147 as a swing center. Accordingly, the distal end portion 145 of the lever member 126 is displaced about the above-described intermediate portion 147. When the distal end portion 145 is displaced relative to the above-described base 120 in the main scanning direction, the above-described base 120 is slid in the feeding direction.

In this movement, an amount of displacement of the distal end portion 145 of the lever member 126 is designated times as large as an amount of displacement of the basal end portion 146 of the lever member 126. Specifically, a magnification of this corresponds to a ratio between a distance from the above-described intermediate portion 147 to the above-described distal end portion 145 and a distance from the above-described intermediate portion 147 to the above-described basal end portion 146. Thus, the amount of displacement of the above-described distal end portion 145 is an amount that the amount of displacement of the above-described basal end portion 146 is magnified by the above-described designated magnification. That is, by providing of the lever member 126, an amount of rotation of the above-described rotating plate 125 is converted into an amount of displacement of the above-described base 120 in the feeding direction at the above-described designated magnification.

As shown in FIG. 12, the drive-force transmitting mechanism 124 includes a torque limiter 148 provided on the sheet-discharge roller shaft 92, and gears 149-151. The torque limiter 148 has a flange 153, a friction plate 152, a pressing plate 154, and a coil spring 155 provided on the sheet-discharge roller shaft 92. As a material of a surface of the friction plate 152, a nonwoven fabric may be typically employed. The pressing plate 154 is engaged with the flange 153 through the friction plate 152. The coil spring 155 elastically forces the pressing plate 154 to the flange 153 together with the friction plate 152. When this coil spring 155 presses the pressing plate 154 to the flange 153, a certain friction force is generated therebetween. A force is transmitted between the pressing plate 154 and the flange 153 by the friction force. In other words, torque transmitted between the above-described pressing plate 154 and the above-described flange 153 is restricted to a predetermined amount or less. When an elastic force of the above-described coil spring 155 is set to be relatively large, the above-described restricted torque increases accordingly.

Although not shown clearly in the figure, teeth are formed on a circumferential surface of the pressing plate 154, so as to mesh with the gear 149. Thus, when the pressing plate 154 rotates, the gear 149 also rotates. The gear 150 meshes with the gear 149, and further the gear 151 meshes with the gear 150. However, a rotational central axis of the gear 150 and a rotational central axis of the gear 151 are at right angles to each other, so that the gear 150 and the gear 151 constitute bevel gear trains. As shown in FIG. 11, a circumferential surface of this gear 151 contacts a circumferential surface of the above-described rotating plate 125. In the present embodiment, a torque is transmitted between the gear 151 and the rotating plate 125 by a friction force generated by contacting of the gear 151 and the rotating plate 125. However, it should be understood that teeth may be formed on both of the gear 151 and the rotating plate 125 so as to constitute spur gear trains thereon, whereby the gear 151 and the rotating plate 125 may be connected to each other.

As described above, the rotation restricting means 156 is provided for restricting the rotation of the rotating plate 125. As shown in FIG. 12, this rotation restricting means 156 includes the above-described lock member 139 and lock member 140, a coil spring 157, and a contact member 158 for changing a posture of the lock member 140. The coil spring 157 elastically forces the lock member 139 such that the lock member 139 is engaged with the rotating plate 125. The contact member 158 is brought into contact with the recording head 39 of the ink-jet recording apparatus by the ink-jet recording head 39 sliding in the main scanning direction, thereby changing the posture of the lock member 140 as described below.

The lock member 139 has a crank-like shape. A basal end portion of the lock member 139 is rotatably supported by a support shaft 159. Thus, the lock member 139 can elevate in a direction indicated by arrow 160 about the support shaft 159 as a pivotal center. An engage pawl 161 is provided on a distal end portion of the lock member 139. This engage pawl 161 has a sphenoidal shape. A external shape of the engage pawl 161 corresponds to a shape of wall faces of the notch 131 of the rotating plate 125. Thus, the engage pawl 161 is fitted in the notch 131.

The lock member 139 swings about the support shaft 159, whereby the lock member 139 can change its posture between a posture in which the engage pawl 161 is fitted in the notch 131 by the lock member 139 laying toward the rotating plate 125, and a posture in which the engage pawl 161 is disengaged from the above-described notch 131 by the lock member 139 raised from the rotating plate 125. Here, the posture in which the engage pawl 161 is fitted in the notch 131 is defined as a "rotation restricting posture", while the posture in which the engage pawl 161 is disengaged from the notch 131 is defined as a "rotation allowing posture". However, since the above-described coil spring 157 is provided, the lock member 139 is normally elastically forced so as to take the rotation restricting posture. Thus, in a state in which the engage pawl 161 is fitted in the notch 131, even where the rotating plate 125 is forced to be rotated forwardly, the forward rotation of the rotating plate 125 is restricted because the engage pawl 161 and the forward rotation restricting face 132 (shown in FIG. 14) contact each other in a forward rotating direction.

On the other hand, even in a state in which the engage pawl 161 is fitted in the notch 131, where the rotating plate 125 is rotated reversely, the engage pawl 161 can slide along the reverse rotation allowing face 133 (shown in FIG. 14). Sliding of the engage pawl 161 along the reverse rotation allowing face 133 changes the posture of the lock member 139 toward the rotation allowing posture against the elastic force of the coil spring 155. Thus, the engage pawl 161 reaches the upper face 137 of the rib 128 of the rotating plate 125 and slides on the upper face 137 of the rib 128 with the rotation of the rotating plate 125.

The lock member 140 has a quadratic prism shape. Although not shown in FIG. 12, an engage pawl is formed on a lower end portion of the lock member 140. This engage pawl also has a sphenoidal shape like the engage pawl 161 of the above-described lock member 139. This engage pawl is fitted in the notch 134 (shown in FIG. 14) provided in the rib 129 of the rotating plate 125. The lock member 140 is provided so as to be slidable in the vertical direction in the figure, and is constantly elastically forced downward by a coil spring 162. That is, the engage pawl provided on the lock member 140 is constantly engaged with the rotating plate 125, thereby allowing the forward rotation of the rotating plate 125 while restricting the reverse rotation of the rotating plate 125.

As shown in FIG. 12, the contact member 158 is connected to the basal end portion of the lock member 139. Thus, the contact member 158 is pivotable with the lock member 139 about the above-described support shaft 159. A distal end portion 164 of the contact member 158 has an arm shape extending upward. When the carriage 38 (shown in FIG. 5) of the ink-jet recording head 39 slides in the main scanning direction, the carriage 38 is brought into contact with the distal end portion 164 of the contact member 158. Further, the above-described coil spring 157 is connected to the contact member 158. Thus, the lock member 139 is elastically forced with the contact member 158 as described above. Thus, the carriage 38 is brought into contact with the distal end portion 164 of the contact member 158, whereby the posture of the lock member 139 is forced to be changed to the rotation allowing posture.

9. Manner of Image Recording Operation

There will be next explained a manner of an image recording operation of the multi-function apparatus 10 as the present embodiment.

In the multi-function apparatus 10 as the present embodiment, the operation panel 15 (shown in FIG. 1) is operated, whereby modes of the image recording operation can be selected. That is, a user operates the operation panel 15, thereby arbitrarily selecting what is called a margin recording operation or a non-margin recording operation. When a recording mode is set through the operation panel 15, a signal for commanding the recording mode is transmitted from the ASIC 70 (shown in FIG. 8) to the CPU 65. When receiving this signal, the CPU 65 transmits, to the drive circuit 74 and the drive circuit 75, commands for driving the CR motor 73 and the recording head 39, respectively. Specifically, where the non-margin recording operation is set, the above-described CR motor 73 is driven such that the carriage 38 (shown in FIG. 5) presses the contact member 158 (shown in FIG. 12).

Figure 16:
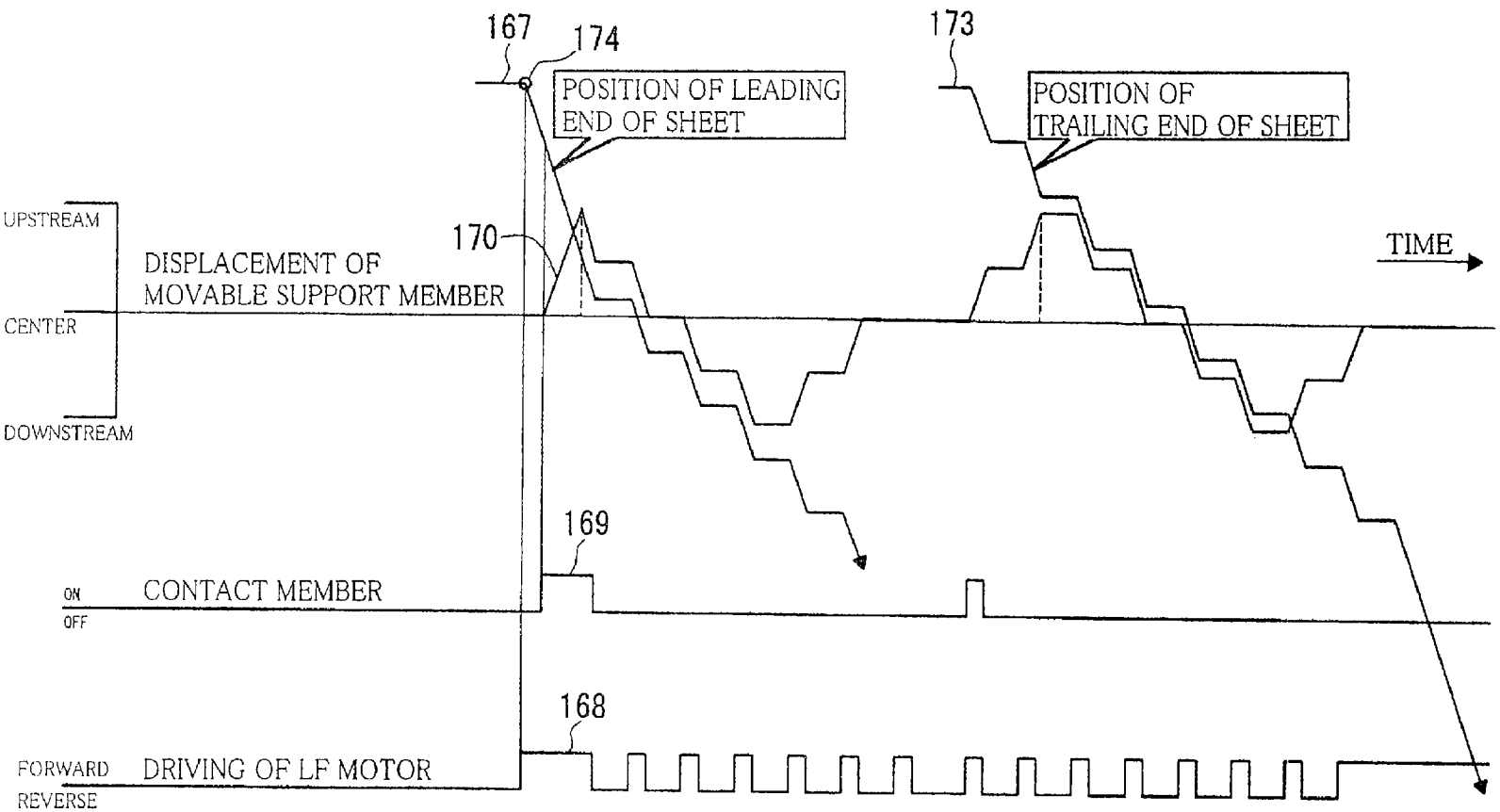
FIG. 16 is a timing chart showing timings of a feeding of a recording sheet and a sliding of the movable support member when a non-margin recording operation is performed.

FIG. 16 is a timing chart showing timings of the feeding of the recording sheet and the sliding of the movable support member 88 when the non-margin recording operation is performed. In the figure, a lateral axis represents an elapse of time. Further, in the figure, a line 167 and a line 173 respectively represent displacements of the leading end and the trailing end of the fed recording sheet. A line 170 represents the displacement of the movable support member 88. Furthermore, in the figure, a line 169 and a line 168 respectively represent a displacement of the contact member 158 and drive timings of the LF motor 71. FIGS. 17A, 17B, 17C, and 17D are views sequentially showing the displacement of the movable support member 88 in the feeding of the recording sheet. In the figures, a direction indicated by arrow 166 is the feeding direction of the recording sheet. It is noted that the figure represents operation timings in a range from after the recording sheet is registered by the sheet-feed roller 60 (shown in FIG. 3) to a completion of the recording of the recording sheet. In the figures, an operation in which the recording sheet supplied from the sheet-supply tray 20 is fed to the sheet-feed roller 60 is omitted.

When the image recording operation is performed, initially, one of the recording sheets stacked on the sheet-supply tray 20 is supplied to the sheet-feed path 23. Specifically, the control section 64 drives the LF motor 71, thereby rotating the sheet-supply roller 25 (as shown in FIG. 3). When the recording sheet is supplied, the LF motor 71 is driven to be reversely rotated, and the sheet-feed roller 60 and the sheet-discharge roller 62 are rotated in a direction opposite to a rotational direction for feeding the recording sheet, which will be referred to as a feeding direction. However, in this movement, the sheet-supply roller 25 is rotated in a direction in which the recording sheet is supplied. The recording sheet supplied from the sheet-supply tray 20 to the sheet-feed path 23 is fed along the sheet-feed path 23 while turning upward. The leading end of the recording sheet is brought into contact with the register sensor 95. When the recording sheet is further fed, the leading end of the recording sheet is brought into contact with the roller 60 and the pinch roller. The sheet-feed roller 60 is rotated in the direction opposite to the feeding direction, whereby the leading end of the recording sheet is not nipped by the sheet-feed roller 60 and the pinch roller in this state. The leading end of the recording sheet is subjected to a registering operation while contacting the sheet-feed roller 60 and the pinch roller. A position of the leading end of the recording sheet in this state is, in FIG. 16, is shown as a registering position 174. After the registering operation of the recording sheet, the control section 64 drives the LF motor 71 to rotate forwardly. Thus, the recording sheet on which the registering operation has been performed is nipped by the sheet-feed roller 60 and the pinch roller, and fed on the platen 42 as indicated by the line 167 in the figure.

The LF motor 71 is rotated reversely as described above, whereby the sheet-discharge roller 62 is rotated in the direction opposite to the feeding direction. As shown in FIG. 12, this reverse rotation of the LF motor 71 is transmitted to the rotating plate 125 via the drive-force transmitting mechanism 124. As shown in the figure, the lock member 140 is normally fitted in the notch 134 (shown in FIG. 13) of the rotating plate 125. In this state, the lock member 139 is fitted in the notch 131 of the rotating plate 125, so that the rotating plate 125 is positioned at its initial rotational position. When the rotating plate 125 is positioned at its initial rotational position, the recording sheet is located at the above-described registering position 174. In this state, the forward rotation and the reverse rotation of the rotating plate 125 are restricted. Thus, only the sheet-discharge roller shaft 92 is rotated reversely in a state in which the reverse rotation of the rotating plate 125 is limited by the torque limiter 148. It is noted that, in supplying the recording sheet, if the rotating plate 125 is not at its initial rotational position, the lock member 140 is not engaged with the notch 134. Thus, the rotation of the sheet-discharge roller 62 is transmitted to the rotating plate 125 by the drive-force transmitting mechanism 124, whereby the rotating plate 125 is rotated reversely. Then, when the rotating plate 125 is rotated reversely to its initial rotational position, the lock member 140 is engaged with the notch 134. Thus, as described above, the reverse rotation of the rotating plate 125 is restricted, so that only the sheet-discharge roller shaft 92 is rotated reversely. Driving the LF motor 71 to be rotated reversely as described above may be set, as an operation for initialize the rotating plate 125 to its initial rotational position, to be performed when the power of the multi-function apparatus 10 is turned on or after removing an error.

Figure 17A:
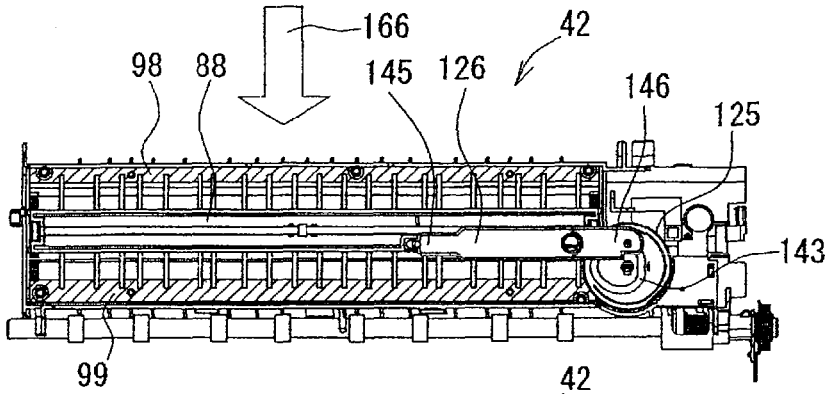
FIGS. 17A, 17B, 17C, and 17D are views sequentially showing a displacement of the movable support member in the feeding of the recording sheet.

When the non-margin recording operation is performed, the movable support member 88 is slid so as to follow the fed recording sheet. More specifically, when the recording sheet is disposed at the above-described registering position 174 (shown in FIG. 16), the movable support member 88 is, as shown in FIG. 17A, located at a center of the platen 42, and the basal end portion 146 of the lever member 126 is disposed at a predetermined position of the guide groove 143 of the rotating plate 125. This predetermined position of the guide groove 143 is a predetermined position indicated at "165" in FIG. 15. It is noted that, in other words, the above-described predetermined position indicated at "165" is a position at which a virtual axis 172 passing through a center of the above-described cylindrical shaft 127 and intersecting the virtual axis 144 at right angles intersects the guide groove 143. A relative positional relationship among the movable support member 88, the rotating plate 125, and the lever member 126 in FIG. 17A represents initial positions of these members which correspond to the initial rotational position of the rotating plate 125.

As described above, after the leading end of the recording sheet is registered on the basis of a position of the sheet-feed roller 60, the LF motor 71 is, as indicated by the line 168 in FIG. 16, intermittently driven to be rotated forwardly. Thus, the recording sheet is fed to a recording position on the platen 42. However, while the recording sheet is fed to the recording position, the CR motor 73 is driven at a predetermined timing as indicated by the line 169. As a result, the carriage 38 (shown in FIG. 5) is slid in the main scanning direction, so as to be brought into contact with the contact member 158 (shown in FIG. 12) of the rotation restricting means 156. A control of an amount of sliding of the carriage 38 in this movement, that is, a control of driving of the CR motor 73 is exercised by the above-described control section 64.

As shown in FIG. 12, when the contact member 158 is pressed by the carriage 38 in the main scanning direction (an "ON" state in FIG. 16), the lock member 139 is pivoted about the support shaft 159 to take the rotation allowing posture. That is, the engage pawl 161 is disengaged from the rotating plate 125, thereby allowing the rotating plate 125 to rotate forwardly (to rotate in a clockwise direction about the cylindrical shaft 127). As described above, when the sheet-discharge roller shaft 92 is rotated in the feeding direction by the LF motor 71, this rotation is transmitted to the rotating plate 125 via the drive-force transmitting mechanism 124, so that the rotating plate 125 is rotated forwardly. As a result, the movable support member 88 is displaced as indicated by the line 170 in FIG. 16, and the relative positional relationship among the movable support member 88, the rotating plate 125, and the lever member 126 is sequentially changed from FIGS. 17B to 17D. Hereinafter, there will be further described the movement of the movable support member 88 in detail.

Figure 17B:
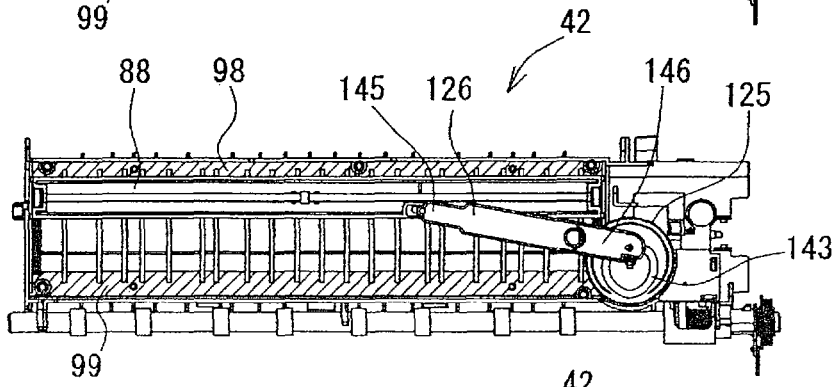

The movable support member 88 is initially located between the first fixed ribs 102 and the second fixed ribs 103 (as shown in FIG. 9). However, as indicated by the line 170 in FIG. 16, when the leading end of the recording sheet is fed to the sheet-feeding-directional upstream end portion 94 of the frame 100 of the platen 42, the movable support member 88 is moved toward the upstream side in the feeding direction to wait for the recording sheet to arrive. Specifically, the forward rotation of the LF motor 71 rotates the sheet-feed roller 60 in the feeding direction. As a result, the recording sheet is fed to the platen 42, and this forward rotation of the LF motor 71 is transmitted, whereby the rotating plate 125 is rotated forwardly. A direction of the rotation of the rotating plate 125 in this case is a clockwise direction in FIGS. 15 and 17. When the rotating plate 125 is rotated forwardly, the position 165 of the basal end portion 146 of the lever member 126 is relatively moved in a direction indicated by arrow 171 in FIG. 15. That is, a distance between the position 165 of the above-described basal end portion 146 and the cylindrical shaft 127 gradually decreases as the rotating plate 125 is rotated. Thus, as shown in FIG. 17B, the lever member 126 swings about the intermediate portion 147 as the swing center, resulting in the movement of the movable support member 88 toward the upstream side in the above-described feeding direction. When a rotation angle of the rotating plate 125 reaches 90°, the movable support member 88 is located at a position at which the same 88 enters between the adjacent ones of the first fixed ribs 102. At the position, the movable support member 88 waits for the recording sheet to arrive. The ribs 121 of the movable support member 88 can support the recording sheet from below. In this case, the movable support member 88 contacts the absorptive pad 98. That is, the front end faces 201 and the front slant faces 202 of the movable support member 88 can contact the absorptive pad 98.

Thereafter, as shown in the figure, the ejections of the ink droplets by the ink-jet recording head 39 with the carriage 38 sliding, and the feedings of the recording sheet at the predetermined line feed pitches corresponding to the set resolution are alternately repeated, whereby the image recording operation is performed on the recording sheet. That is, as indicated by the line 168 in FIG. 16, the LF motor 71 is driven to be intermittently rotated forwardly, whereby the recording sheet is intermittently fed at the predetermined line feed pitches. The recording sheet is thus intermittently fed, whereby the rotating plate 125 is, in synchronization with this movement, intermittently rotated at predetermined rotation angles. The position 165 of the basal end portion 146 of the lever member 126 is further moved in the direction indicated by the arrow 171 in FIG. 15. When the rotation angle of the rotating plate 125 reaches 360°, the position 165 returns to the above-described initial rotational position.

Figure 17C:
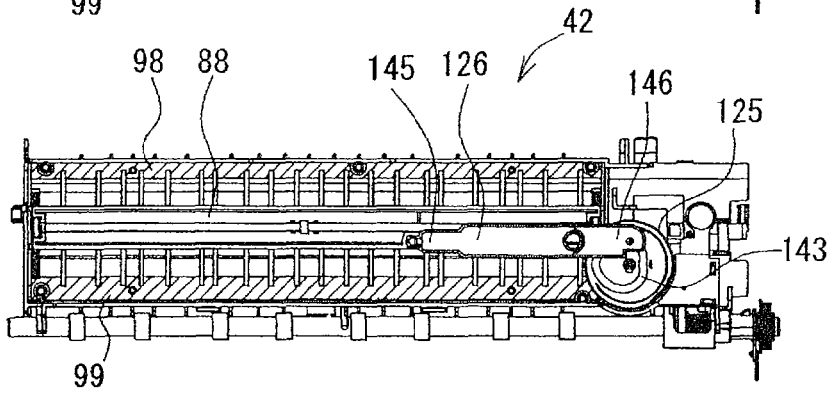
Figure 17D:
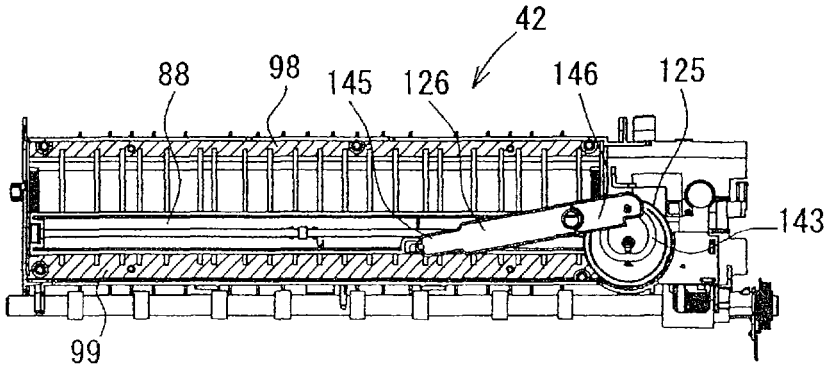

That is, where the rotation angle of the rotating plate 125 is more than 90° and not more than 270°, the distance between the position 165 of the above-described basal end portion 146 and the cylindrical shaft 127 gradually increases as the rotating plate 125 is rotated. As shown in FIGS. 17B to 17D, the lever member 126 swings about the intermediate portion 147 as the swing center, resulting in the movement of the movable support member 88 toward the downstream side in the above-described feeding direction. When the rotation angle of the rotating plate 125 reaches 270°, the movable support member 88 is located at a position at which the same 88 enters between the adjacent ones of the second fixed ribs 103. In this case, the movable support member 88 contacts the absorptive pad 99. That is, the above-described step portions 207 of the movable support member 88 can contact the absorptive pad 99.

Further, the rotating plate 125 is rotated, whereby the distance between the position 165 of the above-described basal end portion 146 and the cylindrical shaft 127 gradually decreases as the rotating plate 125 is rotated. Thus, the lever member 126 swings about the intermediate portion 147 as the swing center, resulting in the movement of the movable support member 88 toward the upstream side in the above-described feeding direction. The rotation angle of the rotating plate 125 reaches 360°, the movable support member 88 returns to the above-described initial position (FIG. 17A).

While the rotating plate 125 is thus being rotated, the engage pawl 161 slides, as shown in FIG. 12, on the upper face 137 of the rib 128. Thus, when the rotation angle of the rotating plate 125 reaches 360°, the engage pawl 161 being forced by the coil spring 157 is fitted in the notch 131 (shown in FIG. 14) of the rotating plate 125 again, thereby restricting the forward rotation of the rotating plate 125. When the forward rotation of the rotating plate 125 is restricted, the drive-force transmitting mechanism 124 is stopped. However, since the torque limiter 148 is provided, the drive force of the LF motor 71 is transmitted to the sheet-feed roller 60 and the sheet-discharge roller shaft 92. Thus, a smooth feeding of the recording sheet is ensured.

In a state in which the smooth feeding of the recording sheet is ensured, the image recording operation performed on the recording sheet is continued. In this time, as indicated by the line 170 in FIG. 16, the movable support member 88 is stopped. However, as indicated by the line 173, the trailing end of the recording sheet moves nearer to the sheet-feeding-directional upstream end portion 94 of the platen 42 as the recording sheet is fed. The trailing end of the recording sheet is detected by the register sensor 95. On the basis of this detection signal, the control section 64 controls the driving of the CR motor 73, whereby, as indicated by the line 169 in FIG. 16, the carriage 38 is slid in the main scanning direction to be brought into contact with the above-described contact member 158 which is shown in FIG. 12 (the "ON" state in FIG. 16).

When the contact member 158 is pressed by the carriage 38 in the main scanning direction, the lock member 139 is pivoted about the support shaft 159, whereby the engage pawl 161 is disengaged from the rotating plate 125 in a manner similar to that described above. Thus, the rotating plate 125 is allowed to rotate forwardly (in a clockwise direction about the cylindrical shaft 127). As a result, the movable support member 88 is displaced as indicated by the line 170 in FIG. 16, and the relative positional relationship among the movable support member 88, the rotating plate 125, and the lever member 126 is sequentially changed from FIGS. 17B to 17D again. That is, before the trailing end of the recording sheet reaches the sheet-feeding-directional upstream end portion 94 of the platen 42, the LF motor 71 is intermittently driven, whereby the movable support member 88 is intermittently moved to the sheet-feeding-directional upstream end portion 94. As a result, the movable ribs 121 of the movable support member 88 are covered with the fed recording sheet from above.

Thereafter, as shown in the figure, the ejections of the ink droplets by the ink-jet recording head 39 with the carriage 38 sliding, and the feedings of the recording sheet at the predetermined line feed pitches corresponding to the set resolution are alternately repeated, whereby the image recording operation performed on the recording sheet is continued. Since the rotating plate 125 is rotated while being linked to the driving of the LF motor 71, the LF motor 71 is, as described above, intermittently driven, whereby the rotating plate 125 is, in synchronization with this movement, also intermittently rotated at the predetermined rotation angles. In this state, the movable ribs 121 are slid toward the downstream side in the feeding direction while supporting the recording sheet.

When the rotating plate 125 is rotated by 360°, the engage pawl 161 being forced by the coil spring 157 is fitted in the notch 131 (shown in FIG. 14) of the rotating plate 125 again, whereby the forward rotation of the rotating plate 125 is restricted, and the movable support member 88 and the lever member 126 return to their respective positions corresponding to the initial rotational position of the rotating plate 125. When the image recording operation performed on the recording sheet is completed, the LF motor 71 is continuously driven to be rotated forwardly, whereby the recording sheet is discharged onto the sheet-discharge tray 21 (shown in FIG. 3). It is noted that, in this time, although the rotation of the rotating plate 125 is restricted, the sheet-discharge roller 62 is smoothly rotated owing to the above-described torque limiter 148 (shown in FIG. 12).

Further, where the mode of the image recording operation is set to the margin recording operation through the operation panel 15, the carriage 38 is not brought into contact with the contact member 158. Thus, the above-described rotating plate 125 remains at its initial rotational position, so that the above-described movable support member 88 is not slid as described above. It is noted that, also in performing the margin recording operation, the LF motor 71 is preferably rotated reversely before the recording sheet is supplied. In this case, as described above, even if the lock member 140 is not engaged with the rotating plate 125, the lock member 140 is certainly fitted in the notch 134 of the rotating plate 125 by the rotating plate 125 rotated reversely. As a result, the initialization is reliably performed.

10. Advantages of Multi-function Apparatus as the Present Embodiment

In the multi-function apparatus 10 as the present embodiment, the recording sheet fed onto the platen 42 is supported by the platen 42, and the ink-jet recording head 39 ejects the ink droplets while being slid in the main scanning direction, whereby the image is recorded on the recording sheet. This recording sheet is further fed in the feeding direction while being subjected to the image recording operation. In this movement, as shown in FIGS. 16 and 17, the movable support member 88 is slid in the feeding direction while supporting the recording sheet, whereby the end portion of the recording sheet is constantly supported by the movable ribs 121 during the image recording operation. Thus, the recording sheet is not warped in the feeding direction. Further, as in the present embodiment, even where the depressed area 116 (shown in FIG. 9) is provided between the first fixed ribs 102 and the second fixed ribs 103, the recording sheet does not hang down toward the depressed area 116. As a result, a distance between the recording sheet and the ink-jet recording head 39 is kept constant, whereby a high quality recording is realized. In addition, since the movable support member 88 is slid by the LF motor 71 as the drive source, there is an advantage that the movable support member 88 is smoothly slid.

Figure 18:
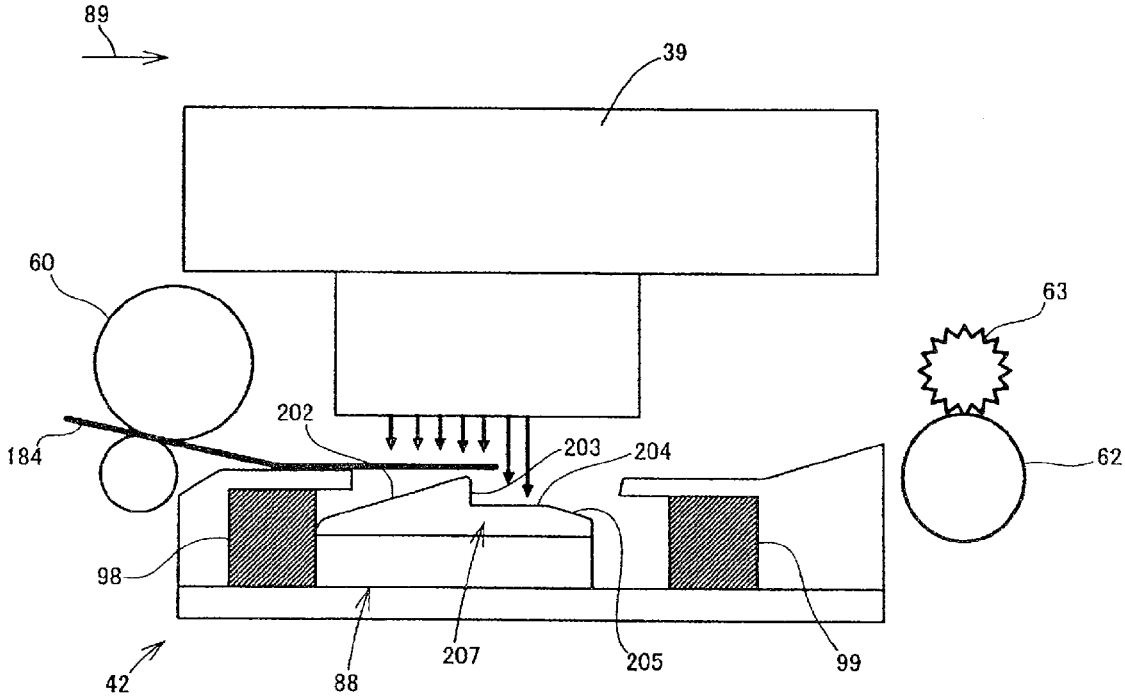
FIG. 18 is a view schematically showing a positional relationship between the recording sheet and the movable support member in a non-margin recording mode in the multi-function apparatus as the first embodiment of the present invention.

FIG. 18 is a view schematically showing a positional relationship between a recording sheet 184 and the movable support member 88 in the non-margin recording mode. The figure represents a positional relationship between the leading end of the recording sheet 184 and the movable support member 88.

Where the non-margin recording operation is performed, the ink-jet recording head 39 ejects the ink droplets to an outside of the leading end of the recording sheet 184. The ink droplets ejected to the outside of the recording sheet 184 fly toward the platen 42 without adhering to the recording sheet 184. The ink droplets flown toward the platen 42 adhere to the step portions 207 of the movable support member 88. Specifically, the ink droplets adhere to the horizontal faces 204 of the movable support member 88. That is, all the ink droplets ejected toward an intermediate portion of the recording sheet 184 other than the leading end thereof adhere to the recording sheet 184. Thus, where the non-margin recording operation is performed, the generation of the ink mist in the vicinity of the platen 42 is prevented, thereby preventing the recording sheet 184 from getting soiled with the ink mist.

As shown in FIGS. 13 and 18, the movable support member 88 includes the vertical wall faces 203. Thus, even where the ink droplets adhere to the horizontal faces 204, these ink droplets are prevented from reaching the top parts of the movable support member 88 by transferring on the respective vertical wall faces 203. That is, the vertical wall faces 203 prevent the ink droplets from transferring to contacting positions between the movable support member 88 and the recording sheet 184. Thus, the recording sheet 184 does not get soiled with the ink droplets adhering to the movable support member 88

In addition, as shown in FIGS. 17 and 18, the platen 42 includes the absorptive pads 98, 99. As described above, the movable support member 88 is slid toward the downstream side in the feeding direction so as to follow the feeding of the recording sheet 184. At a sliding end on the downstream side in the feeding direction, that is, where located at the one of the opposite ends of the sliding range of the movable support member 88, the step portions 207 of the movable support member 88 contact the absorptive pad 99 (as shown in FIG. 17D). Thus, the ink droplets adhering to the horizontal faces 204 and the rear slant faces 205 of the respective step portions 207 are immediately absorbed by the absorptive pad 99. As a result, the platen 42 is prevented from getting soiled with the inks brimming over the horizontal faces 204 and the like. It is noted that when the movable support member 88 is slid to a sliding end on the upstream side in the feeding direction, the front slant faces 202 contact the absorptive pad 98 (as shown in FIG. 18). Thus, if the ink droplets adhere to the front slant faces 202 of the movable support member 88, these ink droplets are immediately absorbed by the absorptive pad 98.

11. Modifications of the Present Embodiment

There will be next explained modifications of the present embodiment.

Figure 19:
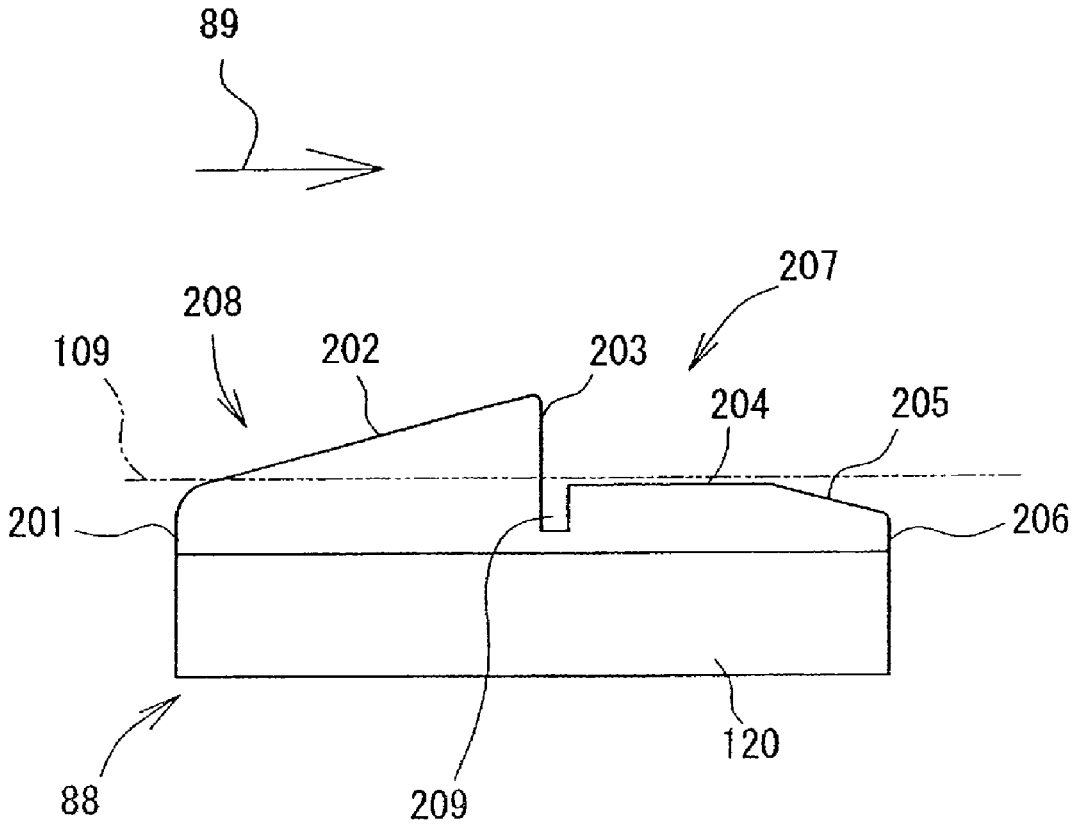
FIG. 19 is an enlarged side view of a movable rib of a first modification of the first embodiment of the present invention.

FIG. 19 is an enlarged side view of one of movable ribs 208 of a first modification of the present embodiment.

A difference of the present modification from the above-described embodiment is that accumulating recesses 209 are respectively formed at boundaries between the vertical wall faces 203 and the horizontal faces 204 of the respective above-described step portions 207. These accumulating recesses 209 are respectively provided at boundary portions between the vertical wall faces 203 and the horizontal faces 204. The accumulating recesses 209 extend in a direction perpendicular to the sheet surface of the figure. In the present embodiment, each of wall faces of the respective accumulating recesses 209 has a rectangular shape. However, the shape of each accumulating recess 209 is not limited to the rectangular shape. In brief, the accumulating recesses 209 are enough to be respectively formed by downwardly recessed portions provided at the above-described boundary portions.

In the present modification, the above-described ink droplets are accumulated and held in the accumulating recesses 209. Thus, the inks are further reliably prevented from transferring upward on the above-described vertical wall faces 203. That is, there is an advantage that the inks are reliably prevented from transferring to the contacting positions between the movable support member 88 and the recording sheet 184.

Figure 20:
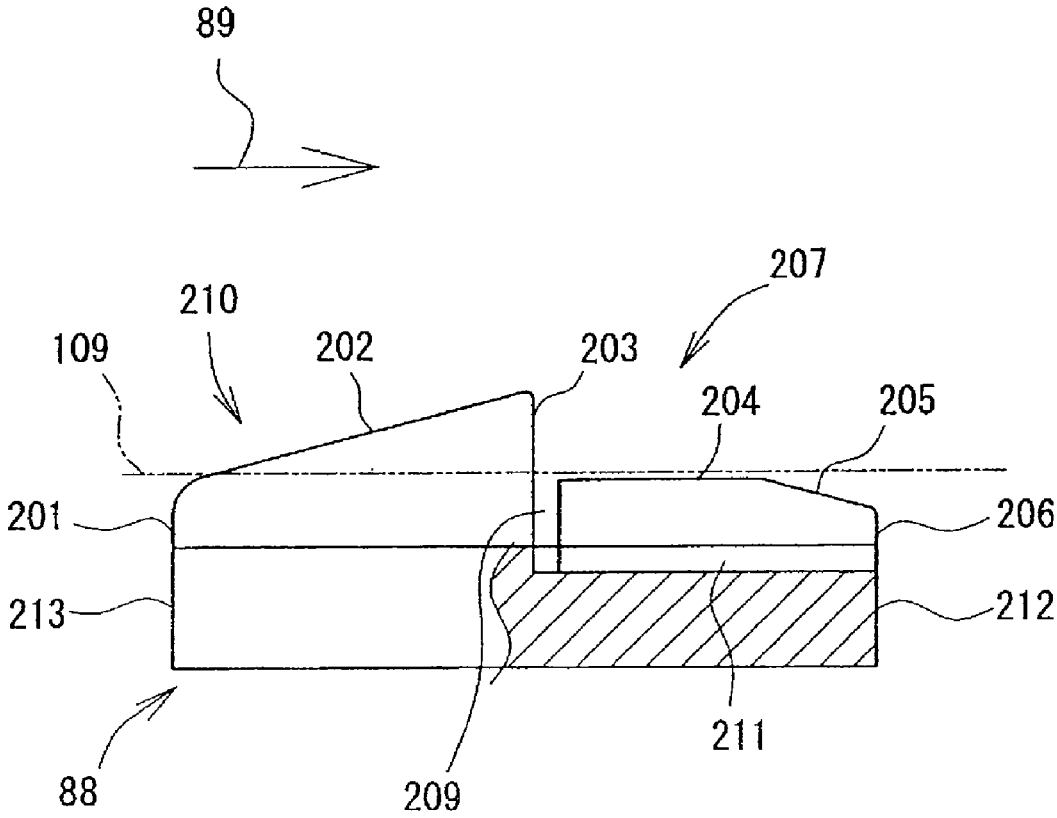
FIG. 20 is an enlarged side view of a movable rib of a second modification of the first embodiment of the present invention.

FIG. 20 is an enlarged side view of one of movable ribs 210 of a second modification of the present embodiment.

A difference of the present modification from the above-described first modification is that guide channels 211 are provided continuously to the respective above-described accumulating recesses 209. These guide channels 211 are continuous to the respective accumulating recesses 209 and extend to respective rear end faces 212 of the movable support member 88. That is, the guide channels 211 respectively connect the accumulating recesses 209 provided in the respective step portions 207 and the rear end faces 212 of the movable support member 88. As described above, when the movable support member 88 is slid to the sliding end on the downstream side in the feeding direction, the step portions 207 are brought into contact with the absorptive pad 99 (as shown in FIG. 17D). Thus, when the step portions 207 of the movable support member 88 are brought into contact with the absorptive pad 99, the accumulating recesses 209 and the absorptive pad 99 are connected via the respective guide channels 211.

In the present modification, when the step portions 207 and the absorptive pad 99 contact each other by the sliding of the movable support member 88, the inks held by the above-described horizontal faces 204 are speedily absorbed by the absorptive pad 99 via the respective rear slant faces 205, and the inks held by the accumulating recesses 209 run in the respective guide channels 211 to be speedily absorbed by the absorptive pad 99. Thus, the inks are prevented from brimming over the above-described horizontal faces 204 and the accumulating recesses 209, thereby reliably preventing the recording sheet 184 and the platen 42 from getting soiled. It is noted that, in the present modification, the movable support member 88 can be considered to be configured such that the guide channels 211 connect the respective step portions 207 and the absorptive pad 99. More specifically, the guide channels 211 can be considered to be configured to connect the respective step portions 207 and the absorptive pad 99 via the respective accumulating recesses 209.

In this modification, when the movable support member 88 is slid, both of the step portions 207 and the guide channels 211 are brought into contact with the absorptive pad 99. However, only the step portions 207 may be brought into contact with the absorptive pad 99, with the above-described guide channels 211 omitted. In this case, the inks held by the horizontal faces 204 are speedily absorbed by the absorptive pad 99 via the respective rear slant faces 205. Further, where the above-described guide channels 211 contact the absorptive pad 99, the step portions 207 may be respectively provided at positions in which the respective step portions 207 do not contact the absorptive pad 99. In this case, the inks held by the accumulating recesses 209 run in the respective guide channels 211 to be speedily absorbed by the absorptive pad 99.

It is noted that the above-described guide channels 211 may be formed so as to respectively connect the accumulating recesses 209 and front end faces 213 of the movable support member 88. In this case, when the movable support member 88 is slid to the sliding end on the upstream side in the feeding direction, the accumulating recesses 209 and the absorptive pad 98 are connected to each other, so that the inks are absorbed by the absorptive pad 98.

Second Embodiment

There will be next explained a second embodiment of the present invention.

Figure 21A:
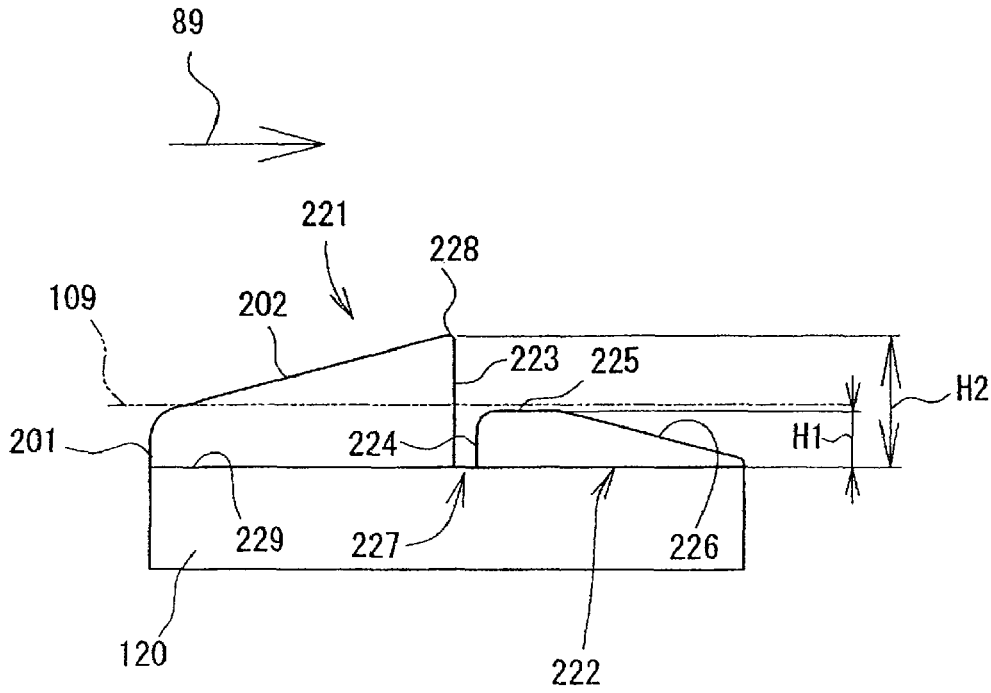
FIG. 21A is an enlarged side view of a movable rib and an ink receiving portion of a second embodiment of the present invention.
Figure 21B:
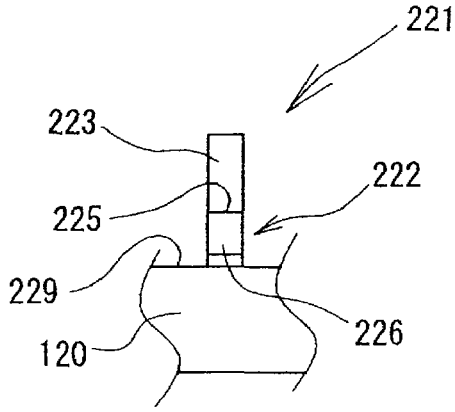
FIG. 21B is a partially enlarged front view thereof.

FIGS. 21A and 21B are enlarged views of one of movable support members of the second embodiment of the present invention. Specifically, FIGS. 21A and 21B are enlarged views of one of movable ribs and one of ink receiving portions (described below) included in the movable support member. It is noted that FIG. 21A is a side view, and FIG. 21B is a front view.

A difference of the movable support member of the present embodiment from the movable support member 88 of the above-described first embodiment is that the above-described movable support member 88 includes the base 120 and the movable ribs 121 each as the supporting portion (as shown in FIGS. 10 and 11) whereas, in the present embodiment, movable ribs 221 each as the supporting portion are provided on an upper face 229 of the base 120, and ink receiving portions 222 are provided adjacent to the respective movable ribs 221. These ink receiving portions 222 are also provided on the upper face 229 of the base 120. It is noted that the other constructions are the same as those of the multi-function apparatus 10 as the above-described first embodiment. It is noted that each of the movable ribs 221 and a corresponding one of the ink receiving portions 222 are each erectly provided in the planar plate shape extending in the feeding direction and are aligned in the feeding direction. Further, the movable ribs 221 and the ink receiving portions 222 are the same in number, and arranged in respective rows in the main scanning direction.

Each of the movable ribs 221 has, in the present embodiment, a quadrangle shape in a side elevational view. That is, the movable ribs 221 respectively have front end faces 201, front slant faces 202 and vertical wall faces 223 as steep slopes. Boundary portions between the respective vertical wall faces 223 and the respective front slant faces 202 constitute respective top parts 228 for supporting the recording sheet. On the other hand, each of the ink receiving portions 222 is formed of the same material as the corresponding movable rib 221 and has a thin plate-like shape. As shown in the FIG. 21B, the thickness of each ink receiving portion 222 corresponds to the thickness of the corresponding movable rib 221. Specifically, the thickness of each movable rib 221 and the thickness of the corresponding ink receiving portion 222 are the same as each other. Each ink receiving portion 222 also has a quadrangle shape. That is, the ink receiving portions 222 respectively include front end faces 224, and upper faces 225 and rear slant faces 226 which provide respective upper ends of the same 222. In the present embodiment, each of the upper faces 225 is a flat face which extends horizontally.

The upper faces 225 and the rear slant faces 226 receive, as described below, the ink droplets ejected from the ink-jet recording head 39. As shown in FIG. 21A, designated clearances 227 are provided between the respective ink receiving portions 222 and the respective movable ribs 221. That is, each ink receiving portion 222 is adjacent to the corresponding movable rib 221 with a clearance formed therebetween. These clearances 227 are defined by the respective above-described vertical wall faces 223 and the respective above-described front end faces 224. A size of each of the clearances 227 is set to be about 1 to 2 mm. Further, a height H1 of the ink receiving portions 222 relative to the upper face 229 of the base 120 is set to be lower than a height H2 of the above-described top parts 228.

In the multi-function apparatus 10 as the present embodiment, the recording sheet 184 fed onto the platen 42 is supported by the platen 42, and the ink-jet recording head 39 ejects the ink droplets while being slid in the main scanning direction, whereby the image is recorded on the recording sheet 184. This recording sheet 184 is further fed in the feeding direction while being subjected to the image recording operation. In this movement, the movable ribs 221 are slid in the feeding direction while supporting the recording sheet 184 (as shown in FIGS. 16 and 17), whereby the end portion of the recording sheet 184 is constantly supported by the movable ribs 221 during the image recording operation. Thus, the recording sheet 184 is not warped in the feeding direction and as in the above-described first embodiment, even where the depressed area 116 (shown in FIG. 9) is formed between the first fixed ribs 102 and the second fixed ribs 103, the recording sheet 184 does not hang down toward the depressed area 116. As a result, the distance between the recording sheet and the ink-jet recording head 39 is kept constant, whereby a high quality recording is realized. In addition, as described above, since the movable support member 88 is slid by the LF motor 71 as the drive source, there is an advantage that the movable support member 88 is smoothly slid.

Figure 22:
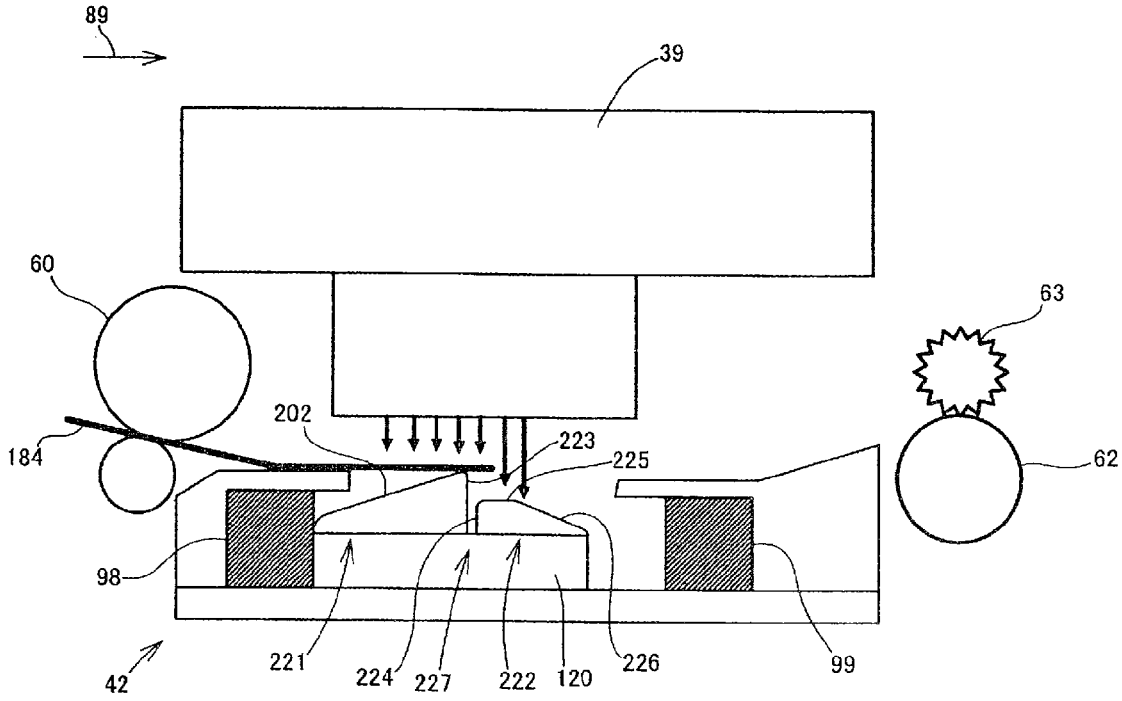
FIG. 22 is a view schematically showing a positional relationship between a recording sheet and the movable rib in the non-margin recording mode in the multi-function apparatus as the second embodiment of the present invention.

FIG. 22 is a view schematically showing a positional relationship between the recording sheet 184 and the movable ribs 221 in the non-margin recording mode. The figure represents a positional relationship between the leading end of the recording sheet 184 and the movable ribs 221.

Where the non-margin recording operation is performed, the ink-jet recording head 39 ejects the ink droplets to an outside of the leading end of the recording sheet 184. The ink droplets ejected to the outside of the recording sheet 184 fly toward the platen 42 without adhering to the recording sheet 184. The ink droplets flown toward the platen 42 reliably adhere to the ink receiving portions 222. Specifically, the ink droplets adhere to the upper faces 225 of the respective ink receiving portions 222. That is, all the ink droplets ejected toward the intermediate portion of the recording sheet 184 different from the distal end portion thereof adhere to the recording sheet 184. Thus, where the non-margin recording operation is performed, the generation of the ink mist in the vicinity of the platen 42 is prevented, thereby preventing the recording sheet 184 from getting soiled with the ink mist.

As shown in FIG. 21, the height H1 of the ink receiving portions 222 is lower than the height H2 of the top parts 228 of the respective movable ribs, so that the recording sheet 184 does not contact the ink receiving portions 222. Accordingly, the ink droplets adhering to the ink receiving portions 222 do not directly transfer to the recording sheet 184. Further, the clearances 227 are formed between the respective movable rib 221 and the respective ink receiving portion 222. Thus, even if the ink droplets move from the ink receiving portions 222 toward the respective movable ribs 221, these ink droplets are caught by the respective clearances 227. That is, the clearances 227 function as traps for catching the ink droplets. Thus, the ink droplets are prevented from transferring on the movable ribs 221 to the recording sheet 184.

Particularly in the present embodiment, the vertical wall faces 223 of the respective movable ribs 221, that is, the steep slopes included in the respective movable ribs 221 define the respective above-described clearances 227. Thus, inks are accumulated in the above-described clearances 227, whereby even where the inks adhere to the vertical wall faces 223, the ink droplets are reliably prevented, owing to gravity acting on the ink droplets, from transferring upward on the vertical wall faces 223 to reach the respective above-described top parts 228. It is noted that, in the present embodiment, the above-described vertical wall faces 223 respectively define the above-described clearances 227, but the wall faces defining the respective clearances 227 are not limited to faces each formed vertically and may be faces each formed at an angle which makes it difficult for the inks to transfer upward. That is, since the clearances 227 are defined by the steep slopes, the traps for catching the ink droplets are formed easily and at a relatively low cost.

Further, in the present embodiment, the upper face 225 of each ink receiving portion 222 is provided by the flat face which extends horizontally. Thus, a head gap with respect to the ink receiving portions 222 can be adjusted over an entire region of the ink receiving portions 222. That is, there is an advantage that the height of the ink receiving portions 222 can be set such that the ink mist is not generated.

Also in the present embodiment, as in the above-described first embodiment, the platen 42 includes the absorptive pads 98, 99 (as shown in FIG. 22). As described above, the movable ribs 221 are slid toward the downstream side in the feeding direction so as to follow the recording sheet 184 being fed. At the sliding end on the downstream side in the feeding direction, the ink receiving portions 222 are brought into contact with the absorptive pad 99 (as shown in FIG. 17D). As a result, the ink droplets adhering to the upper faces 225 and the rear slant faces 226 (shown in FIG. 22) of the respective ink receiving portions 222 are immediately absorbed by the absorptive pad 99. Thus, the platen 42 is prevented from getting soiled with the inks brimming over the upper faces 225 and the rear slant faces 226 of the respective ink receiving portions 222. Further, an amount of the inks flowing from the ink receiving portions 222 to the respective clearances 227 is reduced, whereby the ink droplets are also prevented from brimming over the clearances 227.

It is noted that when the movable ribs 221 are slid to the sliding end on the upstream side in the feeding direction, the front slant faces 202 of the respective movable ribs 221 are brought into contact with the absorptive pad 98 (shown in FIG. 22). Thus, even if the ink droplets adhere to the front slant faces 202 of the respective movable ribs 221, these ink droplets are immediately absorbed by the absorptive pad 99, whereby the platen 42 does not get soiled with the inks brimming over the front slant faces 202.

There will be next explained modifications of the present embodiment.

Figure 23A:
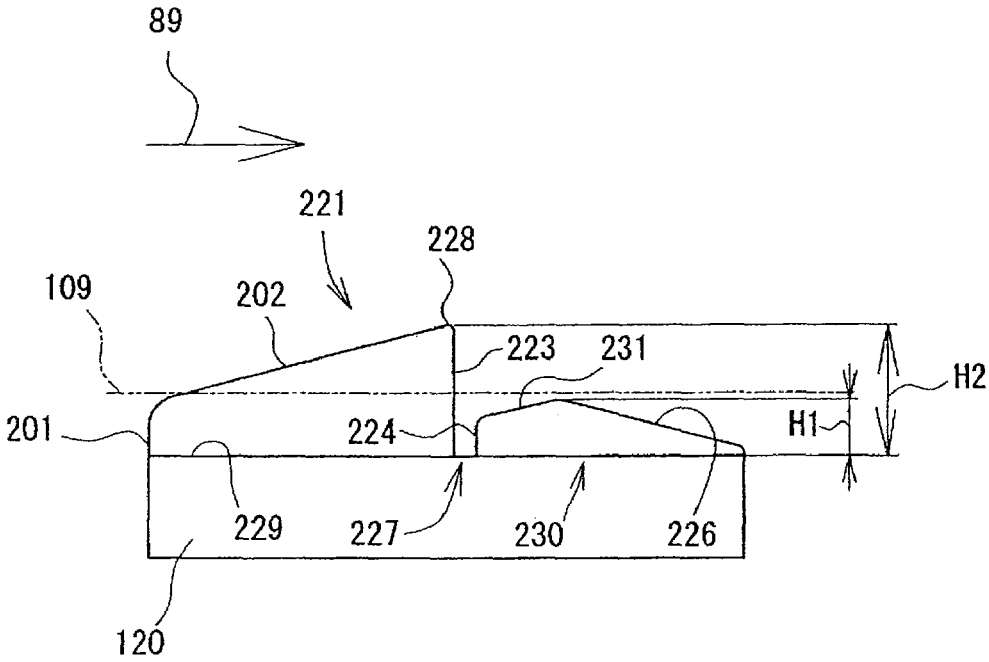
FIG. 23A is an enlarged side view of a movable rib and an ink receiving portion of a first modification of the second embodiment of the present invention.
Figure 23B:
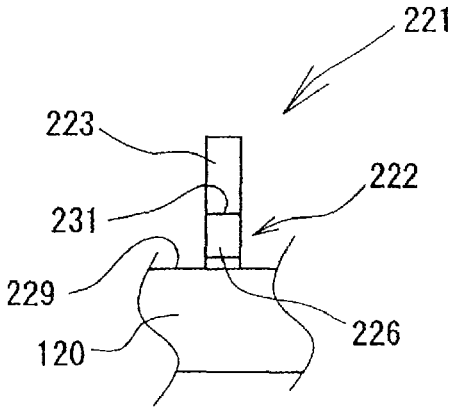
FIG. 23B is a partially enlarged front view thereof.

FIGS. 23A and 23B are enlarged views of one of movable ribs 221 and one of ink receiving portions 230 of a first modification of the present embodiment. FIG. 23A is a side view, and FIG. 23B is a front view.

A difference of the ink receiving portions 230 of the present modification from the ink receiving portions 222 of the above-described embodiment is that the upper faces 225 of the respective above-described ink receiving portions 222 are flat faces which extend horizontally (as shown in FIG. 21) whereas upper faces 231 of the respective ink receiving portions 230 of the present modification incline. Specifically, the upper faces 231 incline downward from the downstream side toward the upstream side in the feeding direction. In other words, a part of an upper end of each of the ink receiving portions 222 near to a corresponding one of the movable ribs 221 inclines downward as being nearer to the corresponding movable rib 221. An angle at which the upper faces 231 incline is not particularly limited, but is preferably set to be more than 15°.

In the present modification, the ink droplets adhering to the ink receiving portions 230 tend to downwardly transfer, owing to gravity, on the respective upper faces 231 toward the upstream side in the feeding direction to the respective clearances 227 provided between the respective ink receiving portions 230 and the respective movable ribs 221. Thus, the inks are not accumulated on the upper faces 231 of the respective ink receiving portions 230. Thus, the inks adhering to the ink receiving portions 230 do not directly transfer to the recording sheet 184. Further, even where the ink droplets adhering to the ink receiving portions 230 transfer into the respective above-described clearances 227, these ink droplets do not, as described above, reach the top parts 228 of the respective movable ribs 221 because the ink droplets are interfered by the respective above-described vertical wall faces 223. Thus, the inks adhering to the vertical wall faces 223 do not transfer to the recording sheet 184, whereby the ink droplets are reliably accumulated in the respective above-described clearances 227.

Figure 24A:
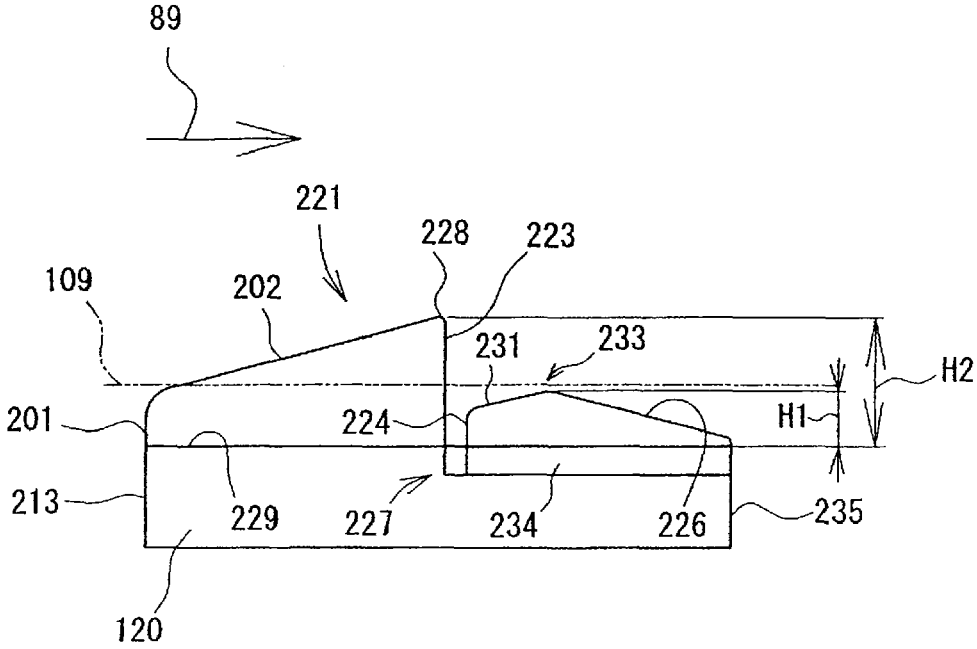
FIG. 24A is an enlarged side view of a movable rib and an ink receiving portion of a second modification of the second embodiment of the present invention.
Figure 24B:
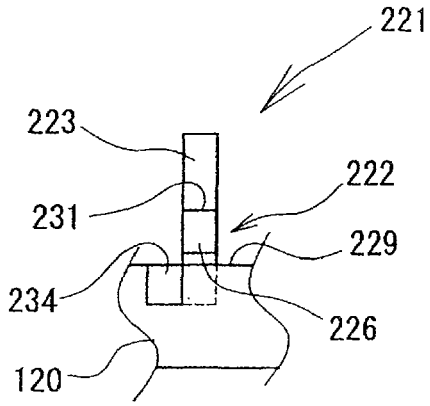
FIG. 24B is a partially enlarged front view thereof.

FIGS. 24A and 24B are enlarged views of one of movable ribs 221 and one of ink receiving portions 233 of a second modification of the present embodiment. FIG. 24A is a side view, and FIG. 24B is a front view.

A difference of the present modification from the above-described first modification is that guide channels 234 are provided respectively continuously to the above-described clearances 227. The guide channels 234 are provided in the base 120 so as to be continuous to the respective above-described clearances 227 and extend to respective rear end faces 235 of the base 120. That is, the guide channels 234 respectively connect the above-described clearances 227 and the rear end faces 235 of the base 120. As described above, when the movable ribs 221 are slid to the sliding end on the downstream side in the feeding direction, the ink receiving portions 233 are brought into contact with the absorptive pad 99 (as shown in FIG. 17D). As a result, the inks held by the above-described upper faces 231 and the rear slant faces 226 are speedily absorbed by the absorptive pad 99, and the inks held by the above-described clearances 227 run in the respective guide channels 234 to be speedily absorbed by the absorptive pad 99. Thus, the inks are prevented from brimming over the above-described upper faces 231 or the clearances 227.

In the present modification, when the movable ribs 221 are slid, both of the ink receiving portions 233 and the guide channels 234 are brought into contact with the absorptive pad 99. However, only the ink receiving portions 233 may be brought into contact with the absorptive pad 99, with the guide channels 234 omitted. In this case, the inks held by the above-described upper faces 231 and the rear slant faces 226 are speedily absorbed by the absorptive pad 99. Further, where the above-described guide channels 234 are brought into contact with the absorptive pad 99, the ink receiving portions 233 may be disposed at positions at which the ink receiving portions 233 do not contact the absorptive pad 99. In this case, the inks held by the clearances 227 run in the respective guide channels 234 to be speedily absorbed by the absorptive pad 99, whereby the inks are prevented from brimming over the clearances 227.

It is noted that the above-described guide channels 234 may be formed so as to respectively connect the clearances 227 and the front end faces 213 of the base 120. In this case, when the movable ribs 221 are slid to the sliding end on the upstream side in the feeding direction (as shown in FIG. 17B), the above-described clearances 227 and the absorptive pad 98 are connected to each other, whereby the inks are absorbed by the absorptive pad 98.

Figure 25A:
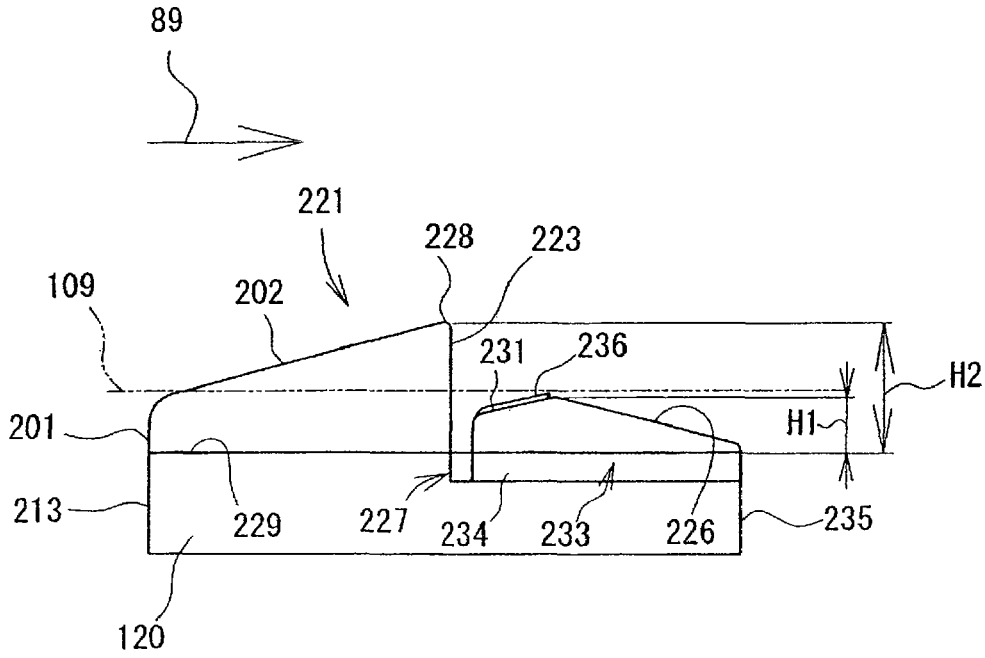
FIG. 25A is an enlarged side view of a movable rib and an ink receiving portion of a third modification of the second embodiment of the present invention.
Figure 25B:
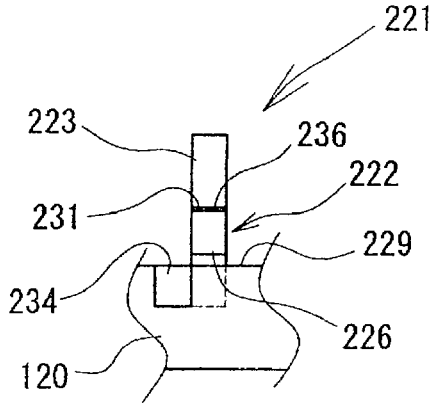
FIG. 25B is a partially enlarged front view thereof.

FIGS. 25A and 25B are enlarged views of one of movable ribs 221 and one of ink receiving portions 233 of a third modification of the present embodiment. FIG. 25A is a side view, and FIG. 25B is a front view.

A difference of the present modification from the above-described second modification is that ink absorbers 236 are respectively provided on the upper faces 231 of the respective ink receiving portions 222. Each of the ink absorbers 236 is formed of a felt or the like, for example, and has an elongate belt shape along a corresponding one of the above-described upper faces 231. In the non-margin recording operation, the ink droplets flown toward the platen 42 are reliably absorbed by these ink absorbers 236. Thus, the generation of the ink mist is further reliably prevented.

Figure 26:
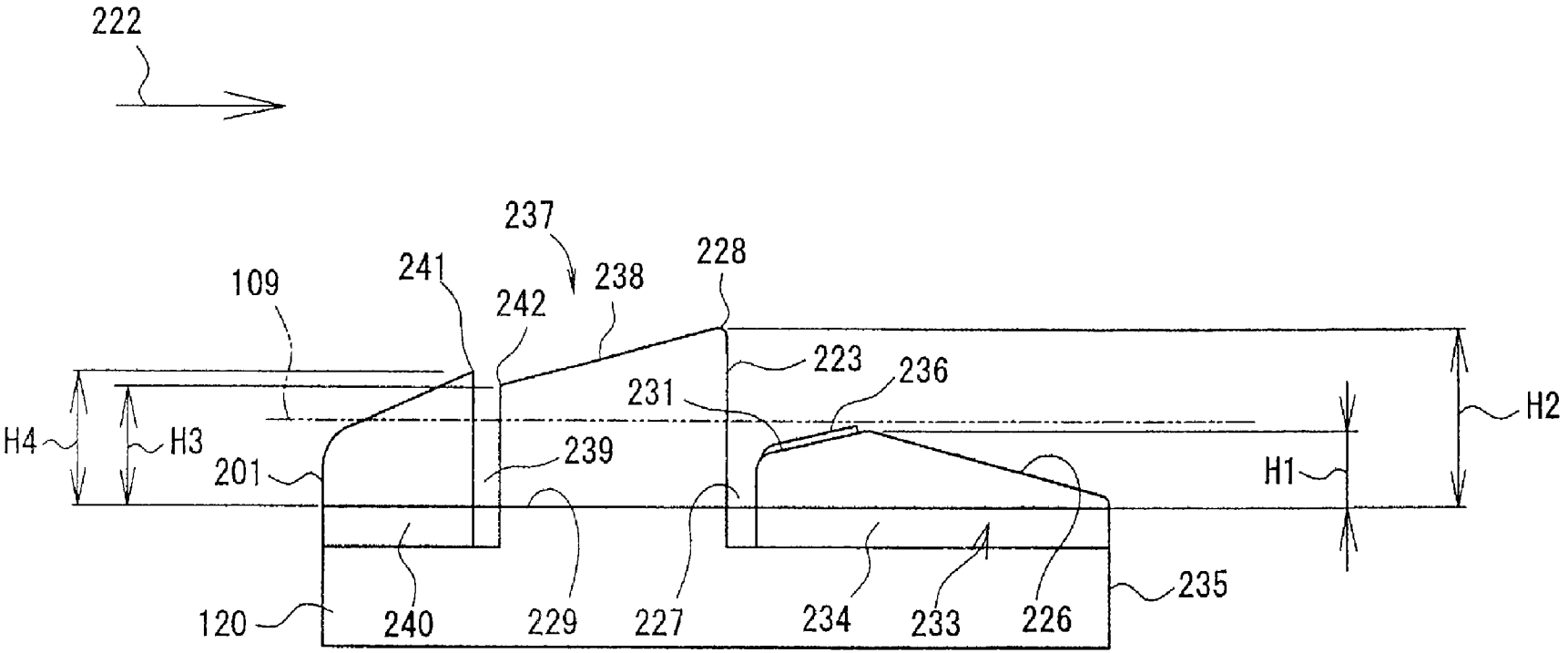
FIG. 26 is an enlarged side view of a movable rib and an ink receiving portion of a fourth modification of the second embodiment of the present invention.
Figure 27A:
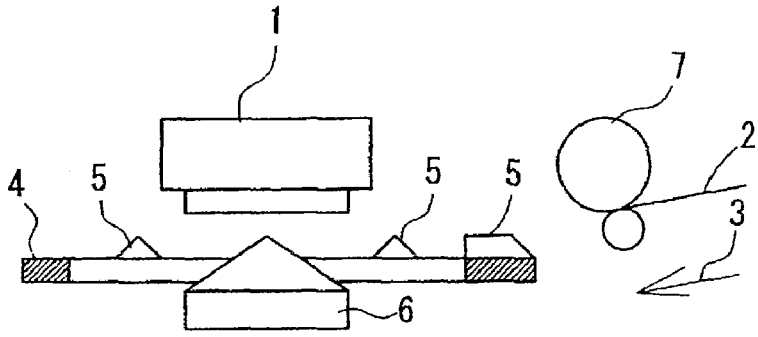
FIGS. 27A, 27B, 27C, and 27D are views schematically showing a manner of the non-margin recording operation in a conventional ordinary ink-jet recording apparatus.
Figure 27B:
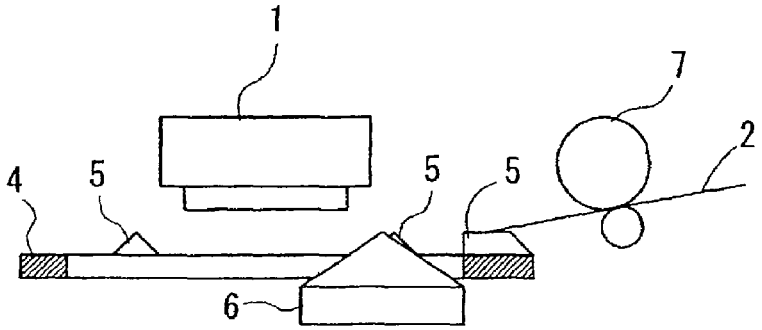
Figure 27C:
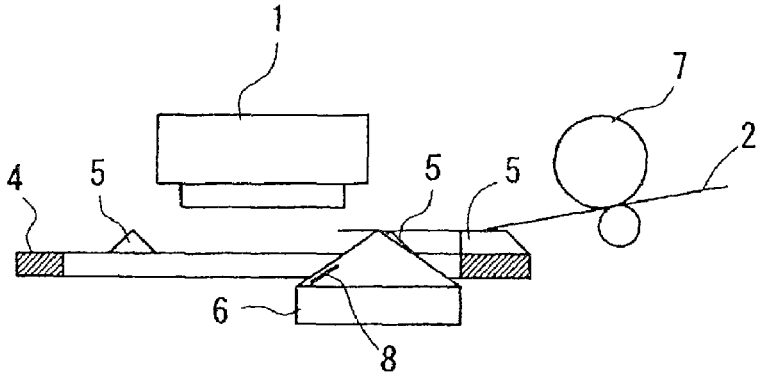
Figure 27D:
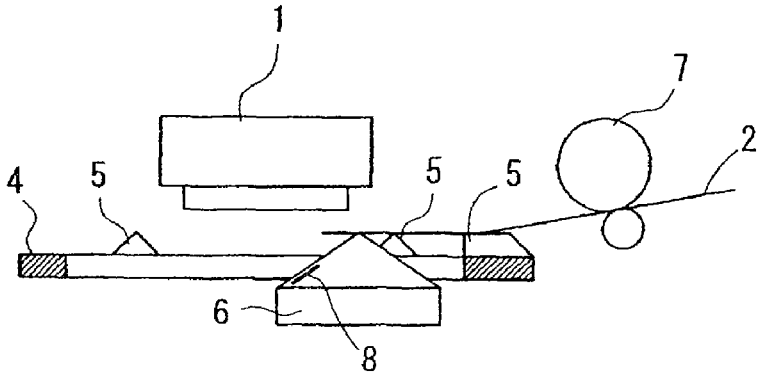

FIG. 26 is an enlarged view of one of movable ribs 237 and one of ink receiving portions 233 of a fourth modification of the present embodiment.

Differences of the present modification from the above-described third modification are that notches extending vertically, that is, recesses 239 opening upward are respectively provided in front slant faces 238 of the respective movable ribs 237, that guide channels 240 are provided continuously to the respective recesses 239, and that a height H3 of end parts 242 located on the downstream side of the respective above-described recesses 239 in the feeding direction is set to be lower than a height H4 of the end parts 241 on the upstream side in the feeding direction. That is, parts of the respective movable ribs 237 which are located on the downstream side of the respective recesses 239 in the feeding direction are lower in height than parts of the respective movable ribs 237 which are located on the upstream side of the respective recesses 239.

The above-described recesses 239 are provided by notches which are vertically formed in the respective movable ribs 237, for example. These recesses 239 are provided on the upstream side of the above-described top parts 228 in the feeding direction. Widths (dimensions in the feeding direction 89) of the respective recesses 239 may be set like those of the above-described clearances 227. In the present modification, the above-described guide channels 240 are provided, and these guide channels 240 have the same shape as the guide channels 234 provided continuously to the respective above-described clearances 227. However, the guide channels 240 are continuous to the respective above-described recesses 239, and extend toward the upstream side in the feeding direction. These guide channels 240 reach the respective front end faces 213 of the base 120. Further, the height H4 of the above-described end parts 241 of the respective movable ribs 237 are set to be higher than the height H3 of the above-described end parts 242, whereby, in each movable rib 237, an angle of inclination of a part of the front slant face 238 which is located on the upstream side of the recess 239 in the feeding direction is greater than an angle of inclination of another part of the front slant face 238 which is located on the downstream side in the feeding direction.

Where the trailing end of the recording sheet 184 is subjected to the non-margin recording operation, the ink droplets ejected to an outside of the trailing end of the recording sheet 184 may adhere to the movable ribs 237 without adhering to the recording sheet 184. In the present modification, since the above-described recesses 239 are provided, the ink droplets adhering to the movable ribs 237 are restricted to transfer to the respective above-described top parts 228 along the respective front slant faces 238. Thus, the inks adhering to the movable ribs 237 are prevented from transferring to the recording sheet 184.

In addition, since the height H4 is set to be higher than the height H3, the leading end of the recording sheet 184 which is fed in the feeding direction 89 does not get snagged on edge portions of the respective recesses 239 (the above-described end parts 242 and the like). Thus, there is an advantage that the recording sheet 184 can be smoothly fed.

Further, in the present modification, the inks adhering to the movable ribs 237 transfer on the respective front slant faces 238 to be caught by the respective above-described recesses 239. That is, these recesses 239 function as traps for catching the ink droplets. Thus, the ink droplets are prevented from transferring on the movable ribs 237 to the recording sheet 184. In addition, the guide channels 240 are provided continuously to the respective recesses 239. As described above, when the movable ribs 237 are slid to the sliding end on the upstream side in the feeding direction, the movable ribs 237 are brought into contact with the absorptive pad 98 (as shown in FIG. 22). Thus, the above-described recesses 239 and the absorptive pad 98 are connected to each other via the respective guide channels 240. Thus, the inks held by the recesses 239 run in the respective guide channels 240 to be speedily absorbed by the absorptive pad 98.

In the present embodiment and the modifications, each of the ink receiving portions 222, 230, 233 may be typically formed of a resin, a rubber, a metal, or the like. However, a material forming each of the ink receiving portions 222, 230, 233 is not limited to the resin or the like, and may be formed of an ink absorbing material in particular. The ink absorbing material includes a felt as a typical material. Where each of the ink receiving portions 222, 230, 233 is formed of the felt or the like, there is an advantage that the ink droplets flown toward the platen 42 are further reliably caught by each of the ink receiving portions 222, 230, 233.

What is claimed is:

1. An ink jet recording apparatus, comprising:

a platen configured to support a recording medium that is fed in a feeding direction;

a recording head comprising a plurality of nozzles disposed so as to be opposed to the platen, and configured to record an image on the recording medium by ejecting ink droplets onto the recording medium fed on the platen while reciprocating in a main scanning direction perpendicular to the feeding direction; and a movable support member which comprises:

a base configured to support the movable support member;

a supporting portion provided on an upper surface of the base which is configured to support the recording medium at a top part thereof and which is configured to slide in a moving direction so as to follow the fed recording medium, the moving direction coinciding with the feeding direction; and an ink receiving portion which is provided on the upper surface of the base on a downstream side of the top part of the supporting portion along the feeding direction, which comprises an uppermost portion, and which is configured to receive ink droplets ejected from the plurality of nozzles when a non-margin recording operation is performed, wherein a distance between the uppermost portion of the ink receiving portion and the upper surface of the base is less than a distance between the top part of the supporting member and the upper surface of the base, wherein a recess is formed in the movable support member and an entirety of the recess is located on an upstream side of the ink receiving portion and on a downstream side of the supporting portion along the feeding direction.

2. The ink jet recording apparatus according to claim 1, wherein the supporting portion comprises a wall face which defines the recess between the ink receiving portion and the supporting portion and which is a steep slope preventing ink adhering to the supporting portion from transferring upward.

3. The ink jet recording apparatus according to claim 1, wherein an ink absorber is provided on an upper part of the ink receiving portion.

4. The ink jet recording apparatus according to claim 1, wherein at least a part of an upper end of the ink receiving portion near to the recess inclines downward as being nearer to the recess in the moving direction.

5. The ink jet recording apparatus according to claim 1, wherein an upper end of the ink receiving portion has a flat face which extends horizontally.

6. The ink jet recording apparatus according to claim 1, wherein the ink receiving portion is formed of a material capable of absorbing ink.

7. The ink jet recording apparatus according to claim 1, wherein, in addition to the recess as a first recess, the movable support member comprises a second recess formed in the supporting portion on an upstream side of the top part in the feeding direction and opening upward.

8. The ink jet recording apparatus according to claim 1, wherein the supporting portion and the ink receiving portion are each erectly provided in a planar plate shape extending in the feeding direction and are aligned in the feeding direction.

9. The ink jet recording apparatus according to claim 8,
wherein the movable support member comprises supporting portions each as the supporting portion and ink receiving portions each as the ink receiving portion, and
wherein the supporting portions and the ink receiving portions are arranged in the main scanning direction.

10. The ink jet recording apparatus according to claim 1,
wherein the movable support member has (i) a downstream wall facing to the supporting portion and located on a downstream side of the supporting portion in the moving direction and (ii) an upstream wall facing to the ink receiving portion and located on an upstream side of the ink receiving portion in the moving direction, and
wherein the recess is defined by the downstream wall and the upstream wall.

11. The ink jet recording apparatus according to claim 10,
wherein a top of the upstream wall as the supporting portion is higher than a top of the downstream wall.

12. The ink jet recording apparatus according to claim 1,
wherein the movable support member comprises a base portion defining a lower end of the recess, the movable support member being provided on the base portion, and
wherein the movable support member has a guide channel defined by the base portion and the ink receiving portion and extending from the recess to a downstream end face of the ink receiving portion in the moving direction, such that the ink in the recess flows through the guide channel.

13. An ink jet recording apparatus, comprising:
a platen configured to support a recording medium that is fed in a feeding direction;
a recording head disposed so as to be opposed to the platen, and configured to record an image on the recording medium by ejecting ink droplets onto the recording medium fed on the platen while reciprocating in a main scanning direction perpendicular to the feeding direction; and
a movable support member which comprises a supporting portion configured to support the recording medium at a top part thereof and configured to slid in a moving direction so as to follow the fed recording medium, the moving direction coinciding with the feeding direction,
wherein the movable support member comprises an ink receiving portion,
which is provided such that a recess is formed in the movable support member between the ink receiving portion and the supporting portion in the moving direction,
which is lower than the top part of the supporting portion in height, and
which is configured to receive ink droplets ejected to an outside of the recording medium,
wherein the recess is formed, such that the ink received by the ink receiving portion flows into the recess,
wherein, in addition to the recess as a first recess, the movable support member comprises a second recess formed in the supporting portion on an upstream side of the top part in the feeding direction and opening upward, and
wherein a part of the supporting portion which is located on a downstream side of the second recess is lower in height than another part of the supporting portion which is located on an upstream side of the second recess.

14. An ink jet recording apparatus, comprising:
a platen configured to support a recording medium that is fed in a feeding direction;
a recording head disposed so as to be opposed to the platen, and configured to record an image on the recording medium by ejecting ink droplets onto the recording medium fed on the platen while reciprocating in a main scanning direction perpendicular to the feeding direction; and
a movable support member which comprises a supporting portion configured to support the recording medium at a top part thereof and configured to slide in a moving direction so as to follow the fed recording medium, the moving direction coinciding with the feeding direction,
wherein the movable support member comprises an ink receiving portion,
which is provided such that a recess is formed in the movable support member between the ink receiving portion and the supporting portion in the moving direction,
which is lower than the top part of the supporting portion in height, and
which is configured to receive ink droplets ejected to an outside of the recording medium,
wherein the recess is formed, such that the ink received by the ink receiving portion flows into the recess, the ink jet apparatus further comprising an ink absorber which is disposed on the platen and which contacts the ink receiving portion when the movable support member is located at one of opposite ends of a sliding range thereof,
wherein the ink absorber is distant from the ink receiving portion when the movable support member is located at an area other than the one of opposite ends in the sliding range.

15. An ink jet recording apparatus, comprising:
a platen configured to support a recording medium that is fed in a feeding direction;
a recording head disposed so as to be opposed to the platen, and configured to record an image on the recording medium by ejecting ink droplets onto the recording medium fed on the platen while reciprocating in a main scanning direction perpendicular to the feeding direction; and
a movable support member which comprises a supporting portion configured to support the recording medium at a top part thereof and configured to slide in a moving direction so as to follow the fed recording medium, the moving direction coinciding with the feeding direction,
wherein the movable support member comprises an ink receiving portion,
which is provided such that a recess is formed in the movable support member between the ink receiving portion and the supporting portion in the moving direction,
which is lower than the top part of the supporting portion in height, and
which is configured to receive ink droplets ejected to an outside of the recording medium,
wherein the recess is formed, such that the ink received by the ink receiving portion flows into the recess, further comprising an ink absorber disposed on the platen,
wherein the movable support member comprises a guide channel which connects the ink absorber and the recess where the movable support member is located at one of opposite ends of a sliding range thereof, and
wherein the guide channel does not connect the ink absorber and the recess when the movable support member is located at an area other than the one of opposite ends in the sliding range.

* * * * *